US008460800B2

(12) United States Patent
Hoshika et al.

(10) Patent No.: US 8,460,800 B2
(45) Date of Patent: Jun. 11, 2013

(54) HIGH-STRENGTH COLD-ROLLED STEEL SHEET EXCELLENT IN BENDING WORKABILITY

(75) Inventors: Tetsuji Hoshika, Kakogawa (JP); Sae Mizuta, Kakogawa (JP); Yuichi Futamura, Kakogawa (JP); Masaaki Miura, Kakogawa (JP); Yukihiro Utsumi, Kakogawa (JP); Hiroaki Matsumoto, Kakogawa (JP); Hiroki Ohta, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 504 days.

(21) Appl. No.: 12/708,109

(22) Filed: Feb. 18, 2010

(65) Prior Publication Data

US 2010/0247957 A1 Sep. 30, 2010

(30) Foreign Application Priority Data

Mar. 31, 2009 (JP) ..... 2009-087407
Mar. 31, 2009 (JP) ..... 2009-087408

(51) Int. Cl.
*B32B 15/01* (2006.01)
*B32B 15/04* (2006.01)
*B32B 15/18* (2006.01)

(52) U.S. Cl.
USPC ..... 428/659; 428/684; 428/213

(58) Field of Classification Search
USPC ..... 428/687, 658, 659, 682, 683, 684, 428/685, 213, 220
See application file for complete search history.

(56) References Cited

U.S. PATENT DOCUMENTS

2011/0287280 A1* 11/2011 Shiraki et al. ..... 428/615

FOREIGN PATENT DOCUMENTS

| | | |
|---|---|---|
| CN | 101351570 A | 1/2009 |
| EP | 1 378 577 A1 | 1/2004 |
| JP | 1-92317 | 4/1989 |
| JP | 6-93340 | 4/1994 |
| JP | 3421943 | 4/2003 |
| JP | 2003-213370 | 7/2003 |
| JP | 2004-68050 | 3/2004 |
| JP | 2005-272888 | 10/2005 |
| JP | 3845554 | 8/2006 |
| JP | 2007-224416 | 9/2007 |

OTHER PUBLICATIONS

Machine Translation, Nomura et al., JP 2004-068050, Mar. 2004.*
Combined Search and Examination Report issued Jun. 1, 2011 in United Kingdom Application No. GB1108030.6.
Office Action issued on Aug. 3, 2011 in the corresponding Chinese Application No. 201010143379.3 (with English Translation).
Combined Search and Examination Report issued Sep. 10, 2010 in United Kingdom Application No. GB1005355.1.

* cited by examiner

*Primary Examiner* — Michael La Villa
(74) *Attorney, Agent, or Firm* — Oblon, Spivak, McClelland, Maier & Neustadt, L.L.P.

(57) ABSTRACT

Disclosed is a cold-rolled steel sheet having a specific steel composition and having a composite steel structure including a ferrite structure and a martensite-containing second phase. In a surface region of the steel sheet from the surface to a depth one-tenth the gage, the number density of n-ary groups of inclusions determined by specific n-th determinations is 120 or less per 100 $cm^2$ of a rolling plane, in which the distance in steel sheet rolling direction between outermost surfaces of two outermost particles of the group of inclusions is 80 μm or more. Also disclosed is a cold-rolled steel sheet having a specific steel composition and having a steel structure of a martensite single-phase structure. In the surface region, the number density of groups of inclusions, in which the distance between the outermost surfaces is 100 μm or more, is 120 or less per 100 $cm^2$ of a rolling plane.

15 Claims, 5 Drawing Sheets

HIGH-STRENGTH COLD-ROLLED STEEL SHEET EXCELLENT IN BENDING WORKABILITY

FIELD OF THE INVENTION

The present invention relates to high-strength cold-rolled steel sheets excellent in bending workability. Specifically, the present invention relates to high-strength cold-rolled steel sheets that have low percentages of rejects caused by fracture in bending.

BACKGROUND OF THE INVENTION

Steel sheets for automobiles are intended to have higher strength in consideration of safety of the automobiles and environmental issues. In general, the workability of a steel sheet decreases with an increasing strength thereof. However, a variety of steel sheets having both high strength and satisfactory workability have been developed and become commercially practical. For example, a steel sheet having a composite structure including a ferrite phase in coexistence with one or more low-temperature transformation phases such as martensite and bainite is used as a high-strength steel sheet excellent in workability. The steel sheet having such a composite structure is designed to improve both the strength and workability by dispersing a hard low-temperature transformation phase in a soft ferrite matrix. Such steel sheets having a composite structure, however, suffer from work fracture starting from inclusions.

Under these circumstances, there have been proposed techniques for improving the workability by controlling inclusions. Typically, Japanese Patent No. 3845554 describes that a cold-rolled steel sheet excellent in bending workability is obtained by controlling the number of inclusions to 25 or less per square millimeter ($mm^2$), which inclusions have diameters in terms of corresponding circles of 5 μm or more. Japanese Unexamined Patent Application Publication (JP-A) No. 2005-272888 describes that a highly ductile cold-rolled steel sheet is obtained by controlling the number of oxide inclusions to 35 or less per square centimeter ($cm^2$) in a silicon-deoxidized steel, which oxide inclusions have minor axes of 5 μm or more. This document also mentions that inclusions are finely divided by controlling the composition of inclusions to one which is liable to expand and break.

However, even when individual inclusions are finely divided and dispersed at a low number density as in the techniques disclosed in the two documents, fracture or cracking starting from inclusions may occur in some distributions of the inclusions. Further investigations are needed so as to reliably increase the workability, especially bending workability required of steel sheets for automobiles. The technique disclosed in Japanese Patent No. 3845554 requires the steel to be a low-sulfur steel, and this leads to increased cost. Japanese Unexamined Patent Application Publication (JP-A) No. 2005-272888 does not refer to the bending workability required of steel sheets for automobiles, among such workabilities.

Independently, Japanese Patent No. 3421943 describes that can-making (plate working) failure of a cold-rolled steel sheet for cans is reduced by controlling the abundance of dot-sequential inclusions to 6003 per square meter ($m^2$) to $2\times10^4$ per square meter, in which the dot-sequential inclusions are observed in an arbitrary cross section in parallel with a rolling plane of the steel sheet. The dot-sequential inclusions herein are a group of three or more oxide inclusions that are arranged linearly at intervals of less than 200 ｆm in parallel with the rolling direction. The steel disclosed in the document, however, is adopted only to cans and needs drawing workability. However, the document does not consider the bending workability needed when used as the steel sheet for automobiles.

As is mentioned above, known high-strength steel sheets with fewer defects caused by inclusions are obtained mainly by strictly controlling the sizes, numbers, and/or amounts of individual inclusions. However, the known steel sheets, when subjected to bending, may suffer from fracture generated sporadically even under remarkably mild working conditions. This lowers the productivity and causes increased cost due typically to inspection of products.

SUMMARY OF THE INVENTION

Under these circumstances, an object of the present invention is to provide a high-strength cold-rolled steel sheet which has a sufficiently minimized rate of bending fracture starting from inclusions and thereby has excellent bending workability.

Specifically, according to a first embodiment of the present invention, there is provided a cold-rolled steel sheet which contains a steel having a composition of a carbon (C) content of from 0.05 percent by mass to 0.3 percent by mass (hereinafter contents will be simply expressed in "%"), a silicon (Si) content of 3.0% or less, a manganese (Mn) content of from 1.5% to 3.5%, a phosphorus (P) content of 0.1% or less, a sulfur (S) content of 0.05% or less, and an aluminum (Al) content of 0.15% or less, with the remainder including iron and inevitable impurities, in which the steel has a microstructure composed of a composite structure including a ferrite structure and a martensite-containing second phase, and, in a surface region from a surface to a depth one-tenth the gage of the steel sheet, the number density of n-ary groups of inclusions is 120 or less per 100 $cm^2$ of a rolling plane, in which each of the n-ary groups of inclusions is determined by an n-th determination mentioned below, and, in each of the n-ary groups of inclusions, the distance in a steel sheet rolling direction between outermost surfaces of two outermost particles of the n-ary group of inclusions is 80 μm or more:

n-th Determination the "n-ary group of inclusions" refers to a group of inclusions which includes an (n−1)-ary group of inclusions (wherein "n" is an integer of 1 or more; when "n" is 1, a "zero-ary group of inclusions" refers to an inclusion particle) and at least one neighboring x-ary group of inclusions (wherein "x" is an integer of from 0 to n−1, where "n" is an integer of 1 or more; a "zero-ary group of inclusions" refers to an inclusion particle), in which the minimum intersurface distance (λ) of nearest neighbor particles between the (n−1)-ary group of inclusions and the x-ary group of inclusions satisfies a condition represented by following Expression (1-1) and is 60 μm or less:

$$\lambda \leqq (1.9-0.0015\sigma_y)\times(d_1+d_2) \quad (1\text{-}1)$$

wherein

λ represents the minimum intersurface distance (μm) of nearest neighbor particles between the (n−1)-ary group of inclusions and the x-ary group of inclusions;

$\sigma_y$ represents the yield strength (MPa) of the steel sheet;

$d_1$ represents the particle size (μm), in a steel sheet rolling direction, of the (n−1)-ary group of inclusions when "n" is 1, or represents the distance (μm), in a steel sheet rolling direction, between outermost surfaces of two outermost particles of the (n−1)-ary group of inclusions when "n" is 2 or more; and $d_2$ represents the particle size (μm), in a steel sheet rolling direction, of the x-ary group of inclusions when "x" is 0, or represents the distance (μm), in a steel sheet rolling direction, between outermost surfaces of two outermost particles of the x-ary group of inclusions when "x" is 1 or more.

The cold-rolled steel sheet according to the first embodiment of the present invention may further contain, as additional element(s), at least one of the following groups of elements (A), (B), (C), and (D):

(A) chromium (Cr) in a content of 1% or less and/or molybdenum (Mo) in a content of 0.5% or less;

(B) at least one element selected from the group consisting of titanium (Ti) in a content of 0.2% or less, vanadium (V) in a content of 0.2% or less, and niobium (Nb) in a content of 0.3% or less;

(C) copper (Cu) in a content of 0.5% or less and/or nickel (Ni) in a content of 0.5% or less; and (D) at least one element selected from the group consisting of calcium (Ca) in a content of 0.010% or less, magnesium (Mg) in a content of 0.010% or less, and at least one rare-earth element in a content of 0.005% or less.

According to a second embodiment of the present invention, there is provided a cold-rolled steel sheet which contains a steel having a composition of a carbon (C) content of from 0.12 percent by mass to 0.3 percent by mass (hereinafter contents will be simply expressed in "%"), a silicon (Si) content of 0.5% or less, a manganese (Mn) content of from 1.5% to 3.0%, an aluminum (Al) content of 0.15% or less, a nitrogen (N) content of 0.01% or less, a phosphorus (P) content of 0.02% or less, and a sulfur (S) content of 0.01% or less, with the remainder including iron and inevitable impurities, in which the steel has a microstructure composed of a martensite single-phase structure, and, in a surface region from a surface to a depth one-tenth the gage of the steel sheet, the number density of n-ary groups of inclusions is 120 or less per 100 $cm^2$ of a rolling plane, in which each of the n-ary groups of inclusions is determined by an n-th determination mentioned below, and, in each of the n-ary groups of inclusions, the distance in a steel sheet rolling direction between outermost surfaces of two outermost particles of the n-ary group of inclusions is 100 μm or more:

n-th Determination the "n-ary group of inclusions" refers to a group of inclusions which includes an (n−1)-ary group of inclusions (wherein "n" is an integer of 1 or more, when "n" is 1, a "zero-ary group of inclusions" refers to an inclusion particle) and at least one neighboring x-ary group of inclusions (wherein "x" is an integer of from 0 to n−1, wherein "n" is an integer of 1 or more; a "zero-ary group of inclusions" refers to an inclusion particle), in which the minimum intersurface distance (λ) of nearest neighbor particles between the (n−1)-ary group of inclusions and the x-ary group of inclusions satisfies a condition represented by following Expression (1-2) and is 60 μm or less:

$$\lambda \leq 4.0 \times 10^5 \left(\frac{1}{\sigma_y}\right)^2 (d_1 + d_2) \quad (1\text{-}2)$$

wherein

λ represents the minimum intersurface distance (μm) of nearest neighbor particles between the (n−1)-ary group of inclusions and the x-ary group of inclusions;

$\sigma_1$ represents the yield strength (MPa) of the steel sheet;

$d_1$ represents the particle size (μm), in a steel sheet rolling direction, of the (n−1)-ary group of inclusions when "n" is 1, or represents the distance (μm), in a steel sheet rolling direction, between outermost surfaces of two outermost particles of the (n−1)-ary group of inclusions when "n" is 2 or more; and $d_2$ represents the particle size (μm), in a steel sheet rolling direction, of the x-ary group of inclusions when "x" is 0, or represents the distance (μm), in a steel sheet rolling direction, between outermost surfaces of two outermost particles of the x-ary group of inclusions when "x" is 1 or more.

The cold-rolled steel sheet according to the second embodiment of the present invention may further contain, as additional element(s), at least one of the following groups of elements (A), (B), and (C):

(A) chromium (Cr) in a content of 2.0% or less and/or boron (B) in a content of 0.01% or less;

(B) at least one element selected from the group consisting of copper (Cu) in a content of 0.5% or less, nickel (Ni) in a content of 0.5% or less, and titanium (Ti) in a content of 0.2% or less; and (C) vanadium (V) in a content of 0.1% or less and/or niobium (Nb) in a content of 0.1% or less.

The first and second embodiments of the present invention also include hot-dip galvanized steel sheets each including any of the cold-rolled steel sheets, and a hot-dip galvanized coating formed on the cold-rolled steel sheet through hot-dip galvanization; and hot-dip galvannealed steel sheets each including any of the cold-rolled steel sheets, and a hot-dip galvannealed coating formed on the cold-rolled steel sheet through hot-dip galvanization and alloying.

The first and second embodiments of the present invention reliably give high-strength cold-rolled steel sheets excellent in bending workability, and these steel sheets can be used as steel sheets for automobiles. Specifically, there are provided steel sheets that are suitable for the manufacture typically of bumping parts such as bumpers and front and rear side members; body-constituting parts including pillar parts such as center pillar reinforcing members; and seat parts.

DETAILED DESCRIPTION OF THE PREFERRED EMBODIMENTS

Figure 1:
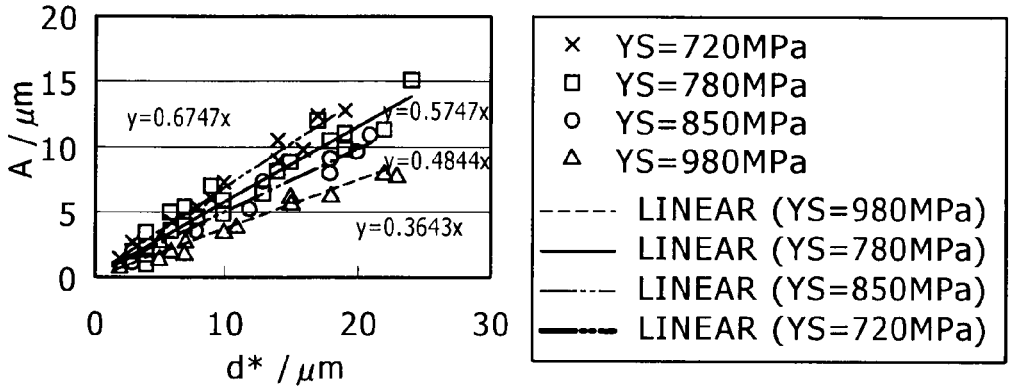
FIG. 1 is a graph showing how a void growth area (A) varies depending on an actual particle size of inclusion (d*) at different yield strengths (YS) of steel sheets in the first embodiment of the present invention.

Initially, how the characteristic properties of a steel vary depending on the state of inclusions will be described. This is in common between the first and second embodiments of the present invention.

The present inventors made intensive investigations in consideration that fracture is generated during processing (particularly during bending) even when the components/compositions of individual inclusion particles are controlled. As a result, the present inventors initially obtained the following findings (1) and (2):

(1) Bending fracture starts from a group of inclusions which are distributed dot-sequentially in parallel with the steel sheet rolling direction.

(2) Even when individual inclusion particles configuring the group of inclusions are finely divided as specified in known technologies, such as one disclosed in Japanese Patent No. 3845554, these individual inclusion particles form a group of inclusions in a dot-sequential distribution, thereby allow voids generated in the vicinity of the individual inclusion particles to coalesce with each other into a defect (void) during processing; and the resulting defect (void) is more coarse and more flat as compared to a void generated in the vicinity of an inclusion particle existing alone. The coarse and flat defect (void) probably receives very large stress concentrated thereon during bending, as compared to the void generated in the vicinity of an inclusion particle existing alone, and this readily leads to the fracture of the steel.

Based on these findings, the present inventors have investigated which specific distribution of inclusion particles causes the coarse and flat defect (void). As a result, the present inventors have initially found that two inclusion particles behave as a group of inclusions which causes one huge defect when the distribution of the two inclusion particles satisfies following Expression (1-1) in the first embodiment of the present invention, or satisfies following Expression (1-2) in the second embodiment of the present invention. Expression (1-1) and Expression (1-2) have been experimentally obtained in consideration of a plastic deformation area caused by the stress concentration in the vicinity of the defect based on the reasoning that "to allow a void generated around an individual inclusion particle to coalesce with a neighboring void, a material present between the two voids should plastically deform":

$$\lambda \leq (1.9 - 0.0015\sigma_y) \times (d_1 + d_2) \tag{1-1}$$

-continued $$\lambda \leq 4.0 \times 10^5 \left(\frac{1}{\sigma_y}\right)^2 (d_1 + d_2) \tag{1-2}$$

wherein $\lambda$ represents the minimum intersurface distance (μm) between an arbitrary inclusion particle and an inclusion particle neighboring thereto;

$\sigma_y$ represents the yield strength (MPa) of the steel sheet;

$d_1$ represents the particle size (μm) of the arbitrary inclusion particle in a steel sheet rolling direction; and $d_2$ represents the particle size (μm) of the neighboring inclusion particle to the arbitrary inclusion in a steel sheet rolling direction.

The parameters $\lambda$, $d_1$, and $d_2$ in Expressions (1-1) and (1-2) are herein defined as above so as to show a fundamental reasoning.

Figure 7:
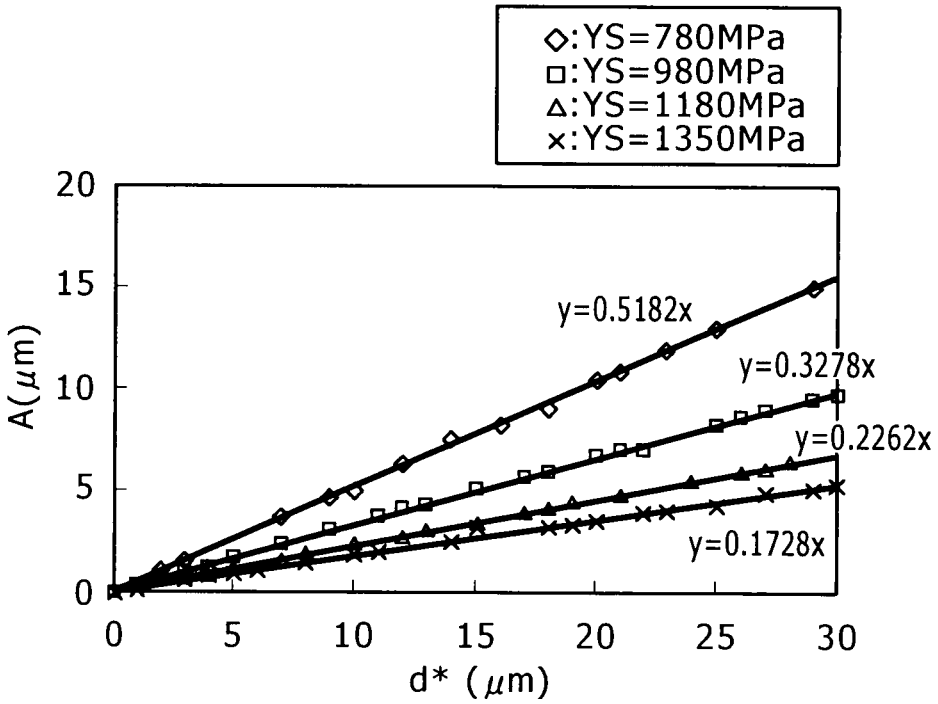
FIG. 7 is a graph showing how a void growth area (A) varies depending on the actual particle sizes of inclusions (d*) at different yield strengths (YS) of steel sheets in the second embodiment of the present invention.

Expression (1-1) and Expression (1-2) are deduced in the following manner. In samples in experimental examples mentioned later (except for Sample No. 4 in Experimental Example 1 which has a low strength), inclusion particles in a fracture surface were observed; actual sizes (actual sizes) (d*) of the inclusion particles and diameters (D) of voids generated around the inclusion particles, respectively, were measured, from which how a void growth area (A=(D−d*)/2) varies depending on the actual size of the inclusion particle (d*) was grasped. The grasped relations between the actual particle size of inclusion (d*) and the void growth area (A) at different yield strengths of steel sheets in the first embodiment and the second embodiment of the present invention are shown in FIG. 1 and FIG. 7, respectively. The results obtained from FIGS. 1 and 7 are sorted out by the yield strength (YS=$\sigma_y$) of steel sheet and lead to following Expression (2-1) regarding the first embodiment of the present invention and following Expression (2-2) regarding the second embodiment of the present invention:

$$\frac{A}{d^*} = 1.5 - 0.0012\sigma_y \tag{2-1}$$

$$A = 3.18 \times 10^5 \left(\frac{1}{\sigma_y}\right)^2 d^* \tag{2-2}$$

In general, the relation between the particle size (d) of an inclusion observed in an arbitrary plane and the actual particle size (d*) of the inclusion is expressed by following Expression (3):

$$d^* = 1.27d \tag{3}$$

In the first embodiment of the present invention, the void growth area (A) is expressed by following Expression (4-1) based on Expression (2-1) and Expression (3):

$$A = (1.9 - 0.0015\sigma_y)d \tag{4-1}$$

In the second embodiment of the present invention, the void growth area (A) is expressed by following Expression (4-2) based on Expression (2-2) and Expression (3):

$$A = 4.0 \times 10^5 \left(\frac{1}{\sigma_y}\right)^2 d \tag{4-2}$$

Accordingly, the present inventors deduced Expression (1-1) and Expression (1-2) based on a reasoning that voids coalesce with each other when the total of void growth areas ($A_1+A_2$) of two neighboring inclusion particles having particle sizes of $d_1$ and $d_2$, respectively, is equal to or more than the minimum intersurface distance (λ) of the two inclusion particles.

In addition, the minimum intersurface distance (λ) of the two inclusion particles is specified to be 60 μm or less in the first and second embodiments of the present invention. This is because, if the minimum intersurface distance λ is more than 60 μm, the correlation between the number density of specific groups of inclusions and the rate of bending fracture caused by specific groups of inclusions mentioned below is low. By specifying the minimum intersurface distance λ to be 60 μm or less, the cost is prevented from increasing as compared to the known technologies in which control is needed even when the distance between inclusion particles is excessively large.

Figure 2A:
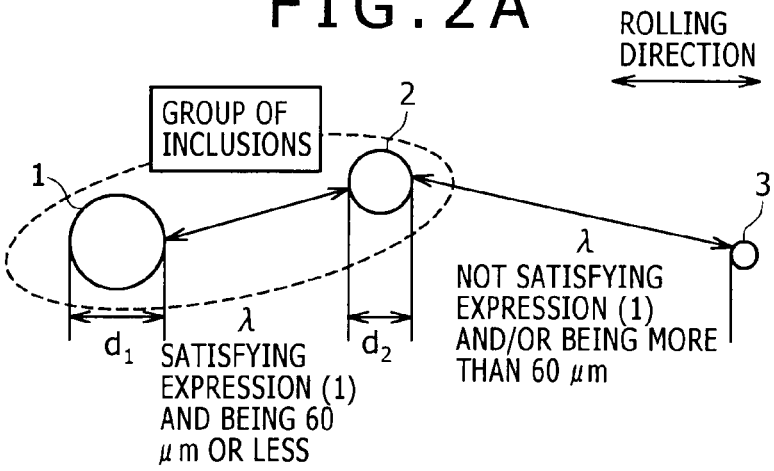
FIGS. 2A and 2B are diagrams illustrating exemplary configurations of primary groups of inclusions.

A group of the two inclusion particles which has a minimum intersurface distance λ satisfying Expression (1-1) and being 60 μm or less is defined as a "group of inclusions" which forms a coarse and flat defect (void) during bending in the first embodiment of the present invention. The group of inclusions is schematically illustrated in FIG. 2A. FIG. 2A demonstrates that an inclusion particle 3 on the far-right portion of the figure does not constitute a group of inclusions with an inclusion particle 2, because the minimum intersurface distance λ between the inclusion particle 3 and the inclusion particle 2 does not satisfy Expression (1-1) and/or is more than 60 μm.

In the above illustration, $d_1$ and $d_2$ are described as in the case where the two objects are inclusion particles, respectively. However, when the group of inclusions composed of two inclusion particles is assumed to be one inclusion particle, a further large group of inclusions may be formed between the assumed inclusion particle (group of inclusions) and a neighboring inclusion particle or neighboring another group of inclusions when the minimum intersurface distance λ between the two satisfies Expression (1-1) and is 60 μm or less. Accordingly, there is a need of performing one or more further determinations (second or later determinations) to determine whether the minimum intersurface distance λ between the group of inclusions composed of two inclusion particles and a neighboring inclusion particle or neighboring another group of inclusions satisfies Expression (1-1) and is 60 μm or less.

The "groups of inclusions" in the present invention can be specified by repeating determinations of groups of inclusions, such as first, second, etc., and n-th determinations step by step. The determinations are performed so as to determine whether two inclusion particles or two groups of inclusions satisfy the conditions (i.e., the minimum intersurface distance λ between the two satisfies Expression (1-1) and is 60 μm or less) and thereby constitute a new group of inclusions.

The determination is repeated until neither inclusion particle nor group of inclusions is present in the neighborhood of a group of inclusions, in which the minimum intersurface distance λ between the two satisfies Expression (1-1) and is 60 μm or less. The finally determined group of inclusions is counted as one group of inclusions.

Figure 3A:
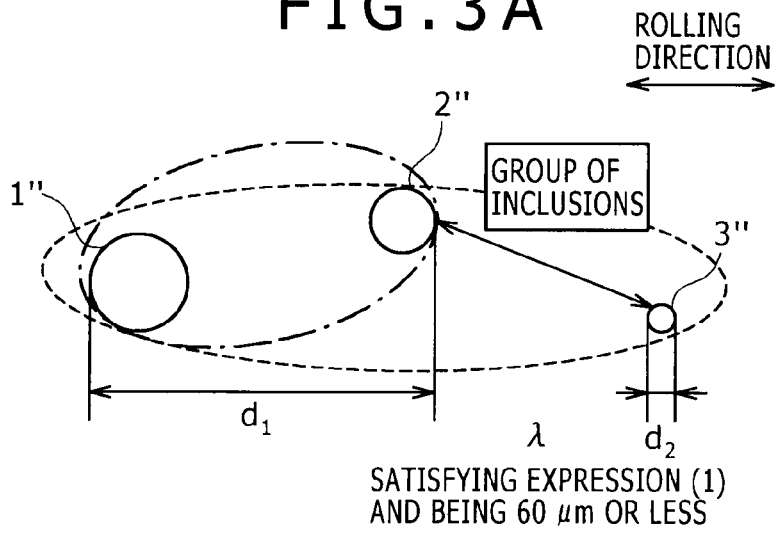
FIGS. 3A and 3B are diagrams illustrating exemplary configurations of secondary groups of inclusions.

For example, a group of inclusions composed of three inclusion particles (1", 2", and 3") is illustrated in FIG. 3A mentioned below. This group of inclusions is a secondary group of inclusions configured by a primary group of inclusions and an inclusion particle 3". The primary group of inclusions contains two inclusion particles 1" and 2" which are determined to satisfy the above conditions and to constitute a group of inclusions (primary group of inclusions) in the first determination. The inclusion particle 3" is determined in the second determination to satisfy the above conditions with the primary group of inclusions and to constitute the secondary group of inclusions. In this case, the number of group of inclusions is not counted as "two" groups of inclusions but as "one" (secondary) group of inclusions composed of the inclusion particle 1", 2" and 3" determined as a group of inclusions in the second determination. In the "two" groups of inclusions, the primary group of inclusions composed of two inclusion particles (1" and 2") is counted separately from the secondary group of inclusions composed of three inclusion particles (1", 2", and 3").

Specifically, a group of inclusions can be determined step by step typically in the following manner, in which determinations of group of inclusions up to third determination are illustrated in detail.

(i) First Determination (Determination of Primary Group of Inclusions)

When the minimum intersurface distance λ between or among at least two inclusion particles satisfies Expression (1-1) and is 60 μm or less, a group of inclusions composed of these inclusion particles is defined as a "primary group of inclusions" (schematically illustrated in FIG. 2A).

Figure 2B:
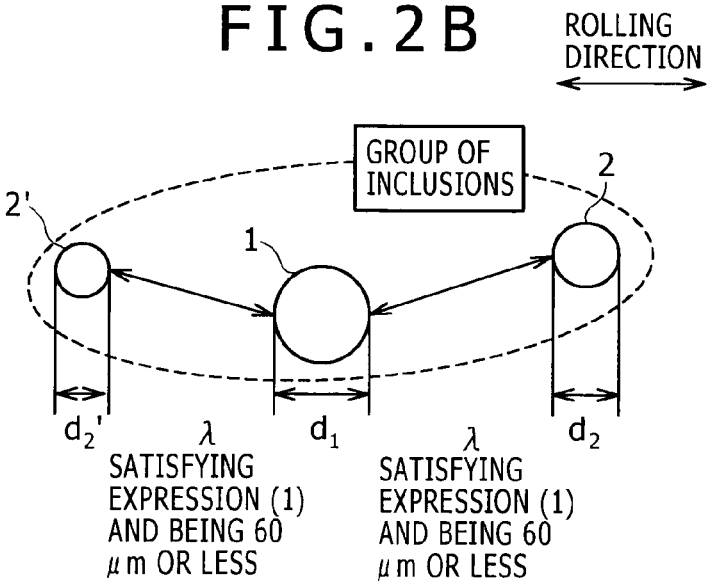

When an inclusion particle 1 satisfies the conditions (the minimum intersurface distance λ satisfies Expression (1-1) and is 60 μm or less) not only with an inclusion particle 2 but also with an inclusion particle 2', a group of inclusions composed of these inclusion particles 1, 2, and 2' is defined as a "primary group of inclusions", as is illustrated in FIG. 2B.

(ii) Second Determination (Determination of Secondary Group of Inclusions)

(ii-1) When the minimum intersurface distance λ satisfies Expression (1-1) and is 60 μm or less between the primary group of inclusions and at least one neighboring inclusion particle, a group of inclusions composed of these is defined as a "secondary group of inclusions". The secondary group of inclusions is schematically illustrated in FIG. 3A.

Figure 3B:
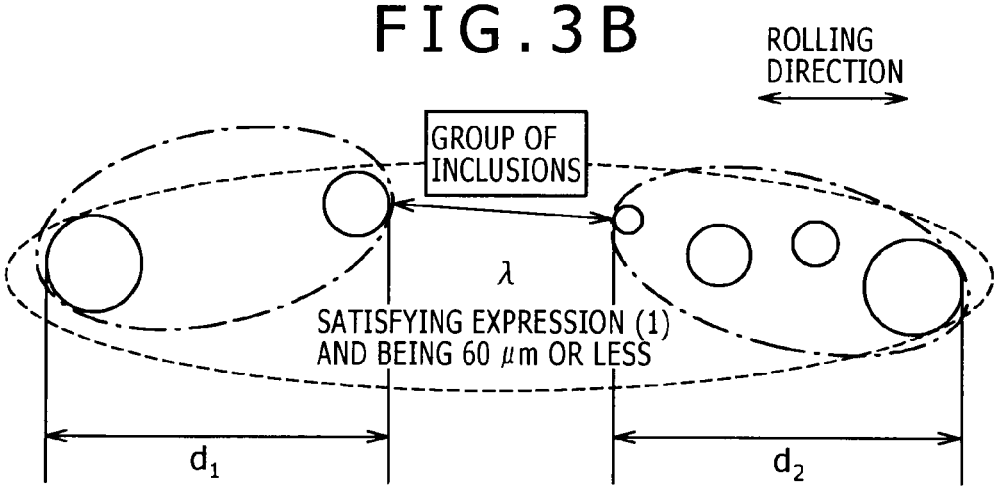

(ii-2) When the minimum intersurface distance λ satisfies Expression (1-1) and is 60 μm or less between the primary group of inclusions and at least one neighboring other primary group of inclusions, a group of inclusions composed of these is defined as a "secondary group of inclusions". This secondary group of inclusions is schematically illustrated in FIG. 3B.

(iii) Third Determination (Determination of Tertiary Group of Inclusions)

(iii-1) When the minimum intersurface distance λ satisfies Expression (1-1) and is 60 μm or less between the secondary group of inclusions and at least one neighboring inclusion particle, a group of inclusions composed of these is defined as a "tertiary group of inclusions".

(iii-2) When the minimum intersurface distance λ satisfies Expression (1-1) and is 60 μm or less between the secondary group of inclusions and at least one neighboring primary group of inclusions, a group of inclusions composed of these is defined as a "tertiary group of inclusions".

(iii-3) When the minimum intersurface distance λ satisfies Expression (1-1) and is 60 μm or less between the secondary group of inclusions and at least one neighboring other secondary group of inclusions, a group of inclusions composed of these is defined as a "tertiary group of inclusions".

The same procedure is continued on a fourth determination (determination of quaternary group of inclusions) and later.

In the second embodiment of the present invention, groups of inclusions are determined by the procedure as in the above-mentioned step-by-step method for determining groups of inclusions in the first embodiment of the present invention, except for using Expression (1-2) instead of Expression (1-1).

An arbitrary group of inclusions (n-ary group of inclusions) is determined in an n-th ("n" is an integer of 1 or more) determination according to the above determination method. This arbitrary group of inclusions (n-ary group of inclusions) can be indicated as follows.

Specifically, the n-ary group of inclusions refers to a group of inclusions composed of an (n−1)-ary group of inclusions (wherein "n" is an integer of 1 or more; when "n" is 1, a "zero-ary group of inclusions" refers to an inclusion particle) and at least one neighboring x-ary group of inclusions (wherein "x" is an integer of from 0 to n−1, where "n" is an integer of 1 or more; a "zero-ary group of inclusions" refers to an inclusion particle), in which the minimum intersurface distance (λ) of nearest neighbor particles between the (n−1)-ary group of inclusions and the x-ary group of inclusions satisfies following Expression (1-1) and is 60 μm or less in the first embodiment of the present invention; or the minimum intersurface distance (λ) of nearest neighbor particles satisfies following Expression (1-2) and is 60 μm or less in the second embodiment of the present invention:

$$\lambda \leq (1.9 - 0.0015\sigma_y) \times (d_1 + d_2) \quad (1\text{-}1)$$

$$\lambda \leq 4.0 \times 10^5 \left(\frac{1}{\sigma_y}\right)^2 (d_1 + d_2) \quad (1\text{-}2)$$

wherein

λ represents the minimum intersurface distance (μm) of nearest neighbor particles between the (n−1)-ary group of inclusions and the x-ary group of inclusions;

$\sigma_y$ represents the yield strength (MPa) of the steel sheet;

$d_1$ represents the particle size (μm), in a steel sheet rolling direction, of the (n−1)-ary group of inclusions when "n" is 1, or represents the distance (μm), in a steel sheet rolling direction, between outermost surfaces of two outermost particles of the (n−1)-ary group of inclusions when "n" is 2 or more; and $d_2$ represents the particle size (μm), in a steel sheet rolling direction, of the x-ary group of inclusions when "x" is 0, or represents the distance (μm), in a steel sheet rolling direction, between outermost surfaces of two outermost particles of the x-ary group of inclusions when "x" is 1 or more.

The term "determined by an n-th determination" as used in the first embodiment of the present invention refers to that the determination procedure is repeated until neither inclusion particle nor group of inclusions is present in the neighborhood of a group of inclusions, in which the minimum intersurface distance λ between the two satisfies Expression (1-1) and is 60 μm or less; and ultimately one group of inclusions is determined, as is described above. Likewise, the term "determined by an n-th determination" as used in the second embodiment of the present invention refers to that the determination procedure is repeated until neither inclusion particle nor group of inclusions is present in the neighborhood of a group of inclusions, in which the minimum intersurface distance λ between the two satisfies Expression (1-2) and is 60 μm or less; and ultimately one group of inclusions is determined.

In the determination, the lower limit of the particle size, in a steel sheet rolling direction, of inclusion particles to be determined is about 0.5 μm.

Major Axis of Group of Inclusions

Figure 4:
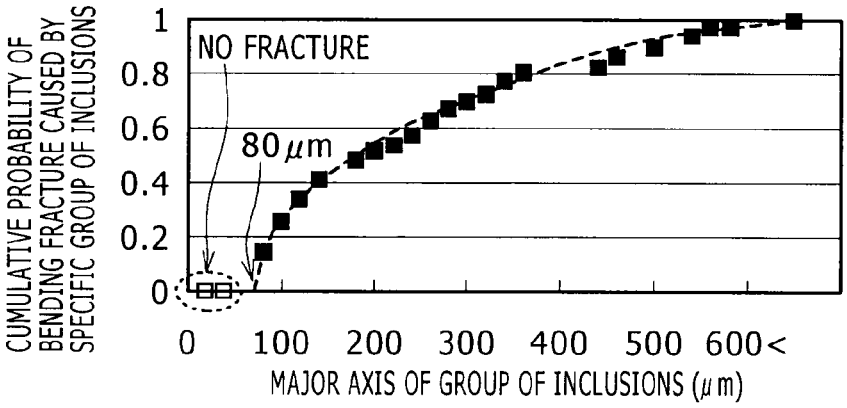
FIG. 4 is a graph showing how a cumulative probability of bending fracture caused by specific groups of inclusions varies depending on the major axes of the specific groups of inclusions in the first embodiment of the present invention.
Figure 8:
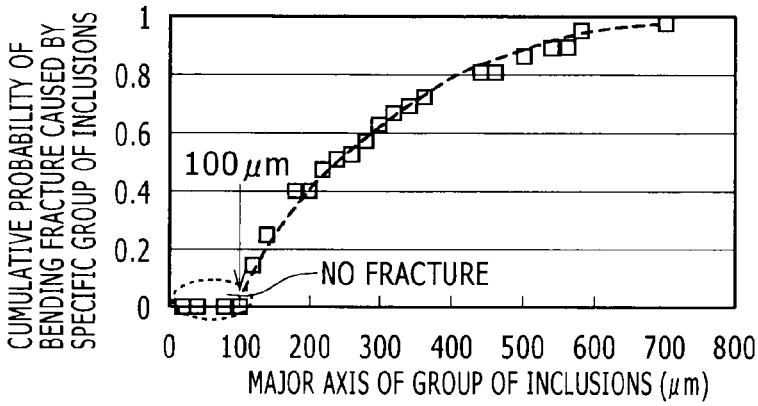
FIG. 8 is a graph showing how a cumulative probability of bending fracture caused by specific groups of inclusions varies depending on the major axes of the specific groups of inclusions in the second embodiment of the present invention.

The influence of such a group of inclusions determined by the determination on the bending workability varies depending on the size of the group of inclusions. The present inventors have made investigations to verify how the bending workability (rate of bending fracture caused by specific groups of inclusions) varies depending on the size of the group of inclusions. As used herein the "size" of a group of inclusions refers to the major axis of the group of inclusions, i.e., the distance in a steel sheet rolling direction between outermost surfaces of two outermost particles of the group of inclusions. FIG. 4 is a graph showing how a cumulative probability of bending fracture caused by specific groups of inclusions varies depending on the major axes of the specific groups of inclusions in the first embodiment of the present invention. Specifically, in samples in after-mentioned Experimental Example 1, except Sample No. 4 having a low strength, fracture surfaces of samples undergoing fracture starting from groups of inclusions were observed; and major axes of the fracture-causing groups of inclusions in a steel sheet rolling direction were measured. The numbers of groups of inclusions having major axes of, for example, 20 μm or more and less than 40 μm, of 40 μm or more and less than 60 μm, of 60 μm or more and less than 80 μm, etc., were counted as groups of inclusions having major axes of 20 μm, 40 μm, 60 μm, etc., respectively; and the cumulative probability of bending fracture caused by specific groups of inclusions was plotted against the major axes at intervals of 20 μm. FIG. 8 is a graph showing the cumulative probability of bending fracture caused by specific groups of inclusions plotted against the major axes at intervals of 20 μm, which data were obtained in the second embodiment of the present invention according to the above procedure.

FIG. 4 demonstrates that fracture is caused by a group of inclusions (cumulative probability is more than 0) when the group of inclusions has a major axis of 80 μm or more. Accordingly, the lower limit of the major axis of a group of inclusions to be controlled according to the first embodiment of the present invention is set to be 80 μm. Likewise, based on data in FIG. 8, the lower limit of the major axis of a group of inclusions to be controlled according to the second embodiment of the present invention is set to be 100 μm. A group of inclusions having a major axis of 80 μm or more is also referred to a "specific group of inclusions" in the first embodiment of the present invention; and a group of inclusions having a major axis of 100 μm or more is also referred to as a "specific group of inclusions" in the second embodiment of the present invention.

Observation Area

An observation area in the present invention is specified by the following measurement based on the fact that a region where bending fracture caused by the specific group of inclusions remarkably occurs is a surface region of the steel sheet which receives a large strain in particular during bending. Specifically, using sample steel sheets in the after-mentioned experimental examples, except Sample No. 4 in Experimental Example 1 having a low strength, a hot spot of defects (position of inclusions) in a rolling plane was previously determined through ultrasonic inspection at frequencies of 30 MHz and 50 MHz. Thereafter bending was performed according to the procedure shown in the after-mentioned experimental examples so that the bending edge line was in parallel with the rolling direction and agreed with the above-determined hot spot of defects (position of inclusions).

As for test pieces which had undergone fracture as a result of bending, fracture surfaces at the fracture starting points were observed. After determining whether any specific group of inclusions was present or not, the position (depth from the surface) of the specific group of inclusions, if present, was measured. Independently, test pieces which had not undergone fracture were ground from the hot spot of defects in the rolling plane to a depth of 0.5t (t: gage) in a thickness direction, and whether any specific group of inclusions was present in a range from the surface to 0.5t deep was determined.

Next, the probability (%) of a specific group of inclusions to cause bending fracture was determined at different measurement positions according to the following equation: Probability (%)=100×(Number of test pieces undergoing bending fracture and containing at least one specific group of inclusions)/[(Number of test pieces undergoing bending fracture and containing at least one specific group of inclusions)+(Number of test pieces undergoing no bending fracture and containing at least one specific group of inclusions). It should be noted that this probability is distinguished from a "rate of bending fracture caused by specific groups of inclusions" mentioned later.

Figure 5:
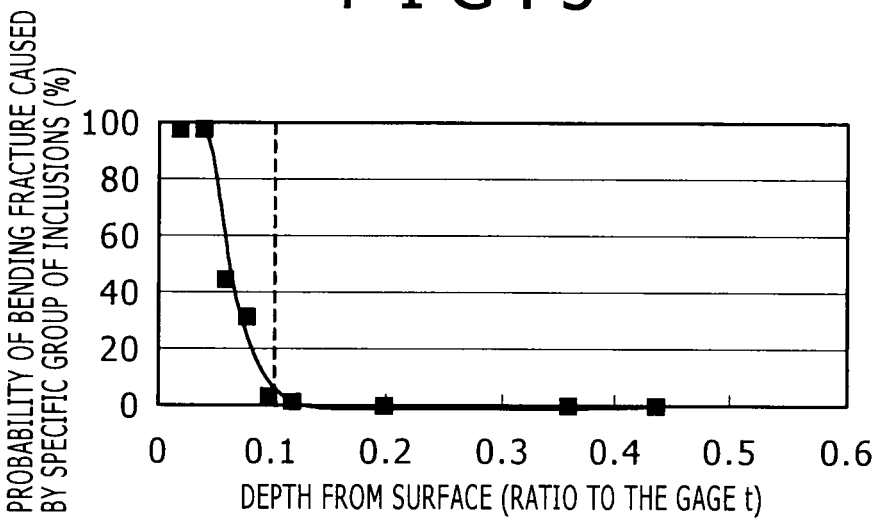
FIG. 5 is a graph showing how a probability of bending fracture caused by specific groups of inclusions varies depending on the positions (depth) of the specific groups of inclusions from the surface of steel sheet (ratio to the gage (thickness) t) in the first embodiment of the present invention.
Figure 9:
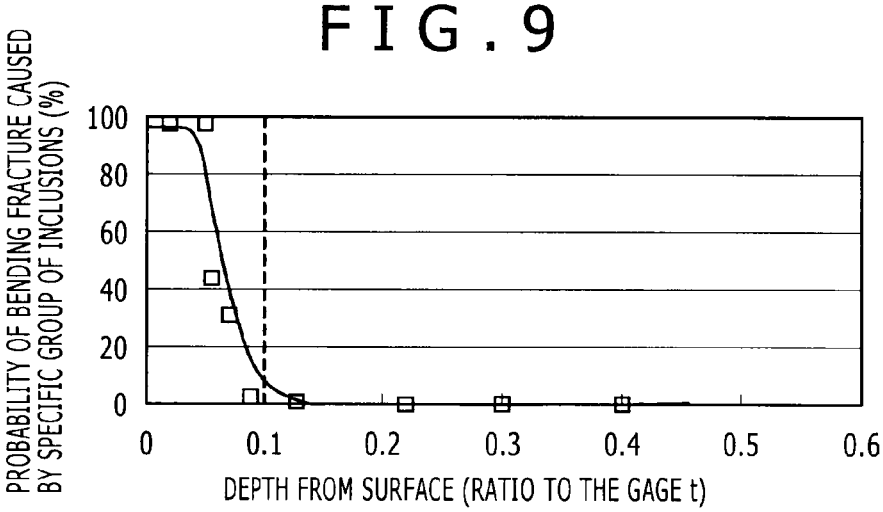
FIG. 9 is a graph showing how a probability of bending fracture caused by specific groups of inclusions varies depending on the positions (depth) of the specific groups of inclusions from the surface of steel sheet (ratio to the gage t) in the second embodiment of the present invention.

The results are sorted out and are shown in FIG. 5 and FIG. 9 on the first and second embodiments of the present invention, respectively. In FIG. 5 and FIG. 9, data of 0.02t (the ratio to the gage t is 0.02), of 0.04t, of 0.06t, etc. are data summarized from measured results in regions of from the surface (depth 0 mm) to a depth of 0.02t, of from a depth of more than 0.02t to a depth of 0.04t, of from a depth of more than 0.04t to a depth of 0.06t, etc., respectively. FIG. 5 and FIG. 9 demonstrate that a specific group of inclusions causes bending fracture when the specific group of inclusions is present in a range of from the surface to a depth of (gage)×0.1 (0.1t) of the steel sheet; and the bending workability is significantly affected by the surface region, both in the first and second embodiments of the present invention. Accordingly, the observation area (area to be observed) is set to a range from the surface to a depth of (gage×0.1) (one-tenth the gage) of the steel sheet in the first and second embodiments of the present invention.

Figure 6:
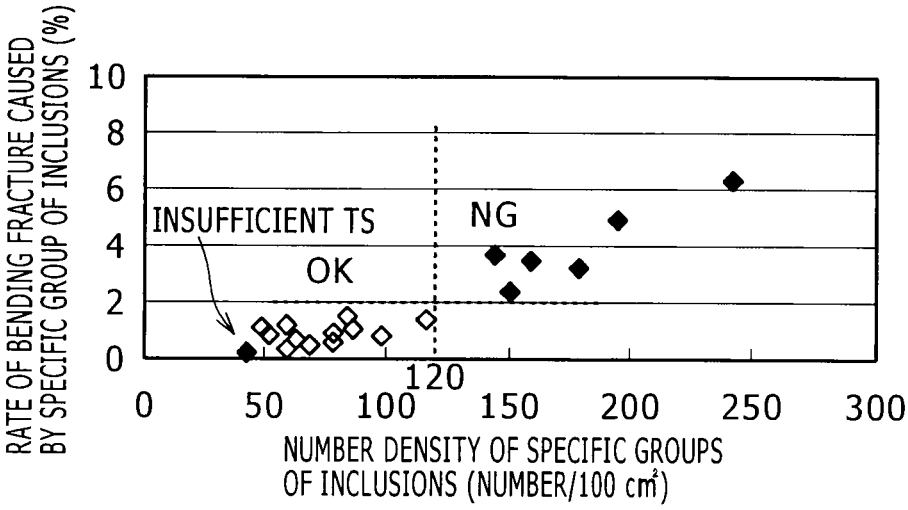
FIG. 6 is a graph showing how a rate of bending fracture caused by specific groups of inclusions varies depending on the number density of the specific groups of inclusions in the first embodiment of the present invention.

Relation Between Number Density of Specific Groups of Inclusions and Bending Workability Next, the present inventors investigated how the bending workability (rate of bending fracture caused by specific groups of inclusions) varies depending on the number density of specific groups of inclusions. Graphs showing how the rate of bending fracture caused by specific groups of inclusions varies depending on the number density of specific groups of inclusions are shown in FIG. 6 for the first embodiment of the present invention and FIG. 10 for the second embodiment of the present invention. These data were determined according to the technique described in the after-mentioned experimental examples. Independently, it has been verified that steel sheets having rates of bending fracture caused by specific groups of inclusions of 2.0% or less show no problems as actual products, both in the first and second embodiments of the present invention.

Figure 10:
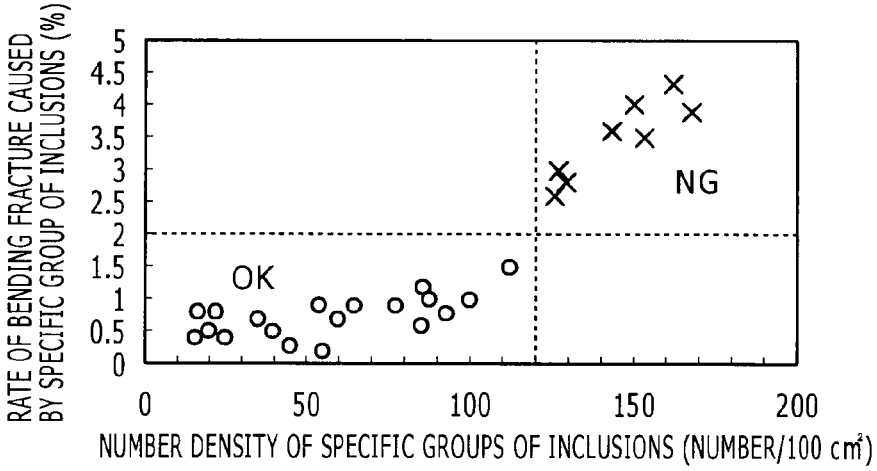
FIG. 10 is a graph showing how a rate of bending fracture caused by specific groups of inclusions varies depending on the number density of the specific groups of inclusions in the second embodiment of the present invention.

Data given in FIG. 6 and FIG. 10 demonstrate that the number density of specific groups of inclusions should be controlled to be 120 or less per 100 $cm^2$ of a rolling plane to achieve a rate of bending fracture caused by specific groups of inclusions of 2.0% or less, both in the first and second embodiments of the present invention. The number density is preferably 100 or less per 100 $cm^2$ of a rolling plane.

The measurement of the specific group(s) of inclusions can be performed, for example, in the visual observation under an optical microscope of 100 magnifications as described in the after-mentioned experimental examples. The measurement can also be performed automatically by binarizing the results in the observation under the optical microscope and subjecting the binarized data to an image analysis in which conditions such as Expression (1-1) or Expression (1-2) and the boundary value (60 μm) of the minimum intersurface distance are previously set.

The first and second embodiments of the present invention specify that the shape or form of a group of inclusions should satisfy the above conditions, but do not specify the compositions of individual inclusion particles constituting the group of inclusions. Exemplary inclusion particles are oxide inclusions containing, for example, one or more of Al, Si, Mn, Ca, and Mg; sulfide inclusions containing, for example, Mn and/or Ti; and composite inclusions of these inclusions. In this connection, Ca and Mg may be contained in inclusions as derived from the furnace wall or due to involution of slag even when these are not added as selective elements. When one or more rare-earth elements are contained in the steel as selective elements in addition to Ca and/or Mg, the steel can contain oxide inclusions and sulfide inclusions (such as sulfide inclusions containing Ca and/or Mg) each containing these elements.

Inclusions are controlled as groups of inclusions both according to the first and second embodiments of the present invention, as described above. In addition, the total number of inclusion particles in the steel sheet is preferably reduced or minimized as in known techniques. Specifically, the number of inclusion particles having particle sizes in a steel sheet rolling direction of 5 μm or more is preferably controlled to be 25 or less per square millimeter ($mm^2$).

Next, the steel composition, steel structure, and manufacturing method of a steel sheet according to the first embodiment of the present invention will be illustrated below. In the following description, the "first embodiment of the present invention" will be simply referred to as "the present invention".

Steel Structure

A cold-rolled steel sheet according to the present invention, when used typically as a steel sheet for automobiles, needs both sufficient strength and satisfactory workability. A ferrite structure (ferrite phase) is effective to ensure excellent workability, but if contained in an excessively large amount, may not help the steel to ensure a high strength of 780 MPa or more. The steel structure therefore preferably further contains at least one low-temperature transformation phase as a second phase. Among such low-temperature transformation phases, a martensite structure (of which a martensite structure including tempered martensite is more preferred) is effectively contained, because the martensite structure provides mobile dislocation in the steel and this is expected to improve the workability. Accordingly, the martensite structure preferably occupies 70 percent by area or more, and more preferably 80 percent by area or more, of the second phase. The second phase may further contain, as the remainder structure, a bainite structure and/or a retained austenite structure within a range not adversely affecting the heightened strength and workability. Specifically, the second structure may contain a bainite structure and/or a retained austenite structure in a content of 30 percent by area or less of the total of the second phase.

The steel sheet according to the present invention may further contain a structure which has been inevitably contained during manufacturing process, such as a pearlite structure, in addition to the ferrite structure and the second phase.

The steel sheet should satisfy the following chemical composition so as to sufficiently exhibit effects of the control of structure, including the form of inclusions, so as to increase the bending workability reliably and to be a steel sheet having high strength and excellent workability in good balance. The steel sheet is recommended to be manufactured under manufacturing conditions mentioned later. Initially, the chemical composition of the steel sheet will be illustrated in detail below.

Chemical Composition of Steel Sheet

Carbon (C) content: 0.05% to 0.3%

Carbon (C) should be contained in the steel sheet in a content of 0.05% or more (preferably 0.07% or more) so as to ensure the strength. However, if the carbon content is more than 0.3%, the steel sheet may show insufficient bending workability, because the different in hardness between the ferrite structure and the second phase becomes excessively large. The carbon content in the present invention should therefore be 0.3% or less and is preferably 0.25% or less.

Silicon (Si) content: 3.0% or less (excluding 0%)

Silicon (Si) element is necessary for the solid-solution strengthening of the ferrite structure so as to ensure the strength. This element is also effective for reducing the difference in hardness between the ferrite structure and the second phase so as to improve the bending workability. From these viewpoints, the Si content is preferably 0.5% or more. However, these effects of Si, if contained in a content of more than 3.0%, may be saturated and may contrarily cause hot shortness. The Si content should therefore be 3.0% or less and is preferably 2.5% or less in the present invention.

Manganese (Mn) content: 1.5% to 3.5%

Manganese (Mn) element is effective for improving hardenability to thereby increase the strength and also acts as a solid-solution strengthening element. The Mn content should therefore be 1.5% or less, and is preferably 1.7% or more. However, Mn, if contained in an excessively high content, may accelerate the formation of a low-temperature transformation phase (martensite structure) more than necessary and may form MnS and other inclusions in a larger amount; and these worsen the bending workability. Accordingly, the Mn content should therefore be 3.5% or less, and is preferably 3.0% or less.

Phosphorus (P) content: 0.1% or less

Phosphorus (P) element acts to worsen the workability, and the phosphorus content should therefore be controlled to be 0.1% or less, and is preferably 0.05% or less.

Sulfur (S) content: 0.05% or less

Sulfur (S) element acts to increase the amounts of inclusions to thereby worsen the bending workability, and the sulfur content should therefore be controlled to be 0.05% or less. The sulfur content is preferably 0.03% or less, more preferably 0.01% or less, and especially preferably 0.005% or less.

Aluminum (Al) content: 0.15% or less

Aluminum (Al) element is necessary for deoxidation, and the lower limit of the Al content is about 0.005%, and especially preferably 0.01%. However, if Al is contained in an excessively high content, not only the deoxidation effect is saturated but also the amounts of inclusions are increased to thereby worsen the bending workability. The upper limit of the Al content should therefore be 0.15%. The Al content is preferably 0.10% or less and more preferably 0.05% or less.

The basic composition of the steel sheet specified in the present invention is as mentioned above, and the remainder includes iron and inevitable impurities. The steel sheet is accepted to contain, as the inevitable impurities, elements brought typically from raw materials, construction materials, and manufacturing facilities. The steel sheet may further positively contain the following elements within ranges not adversely affecting the operation of the present invention.

Chromium (Cr) in a content of 1% or less and/or molybdenum (Mo) in a content of 0.5% or less Chromium (Cr) and molybdenum (Mo) elements help the steel to have improved hardenability to thereby have higher strength. The Cr content and Mo content are preferably 0.05% or more and 0.01% or more, respectively, to exhibit the effects sufficiently. However, the steel, if containing these elements in excess, may have insufficient workability to cause an increased level of bending defectiveness. Accordingly, the Cr content is preferably 1% or less and more preferably 0.8% or less, and the Mo content is preferably 0.5% or less, and more preferably 0.4% or less.

At least one element selected from the group consisting of titanium (Ti) in a content of 0.2% or less, vanadium (V) in a content of 0.2% or less, and niobium (Nb) in a content of 0.3% or less Titanium (Ti), vanadium (V), and niobium (Nb) elements form carbides or nitrides to develop precipitation strengthening. To exhibit the effects sufficiently, the Ti content, vanadium content, and Nb content are each preferably 0.005% or more. However, the steel, if containing these elements in excess, may have insufficient workability to cause an increased level of bending defectiveness. Accordingly, the Ti content is preferably 0.2% or less and more preferably 0.16% or less; the vanadium content is preferably 0.2% or less and more preferably 0.16% or less; and the Nb content is preferably 0.3% or less and more preferably 0.25% or less.

Copper (Cu) in a content of 0.5% or less and/or nickel (Ni) in a content of 0.5% or less Copper (Cu) and nickel (Ni) elements are effective for improving the corrosion resistance of the steel to increase the resistance to delayed fracture. These effects are significantly exhibited particularly in steel sheets having tensile strengths of more than 980 MPa. To exhibit the effects sufficiently, the Cu content and the Ni content are each preferably 0.05% or more. However, the steel, if containing these elements in excess, may show insufficient workability, and the Cu content and the Ni content are each preferably 0.5% or less and more preferably 0.4% or less.

At least one element selected from the group consisting of calcium (Ca) in a content of 0.010% or less, magnesium (Mg) in a content of 0.010% or less, and one or more rare-earth elements in a content of 0.005% or less Calcium (Ca), magnesium (Mg), and rare-earth elements are effective for controlling the forms of inclusions. To exhibit the effects sufficiently, the Ca content is preferably 0.0003% or more, the Mg content is preferably 0.0001% or more, and the rare-earth element content is preferably 0.0005% or more. However, these elements, if contained in excess, may form inclusions in themselves to worsen the bending workability. To avoid this, the Ca content and the Mg content are each preferably 0.010% or less and more preferably 0.008% or less, and the rare-earth element content is preferably 0.005% or less and more preferably 0.004% or less.

The "rare-earth elements" refer to lanthanoid elements, i.e., a total of fifteen elements from lanthanum (La) to lutetium (Lu) in the periodic table. Of these rare-earth elements, lanthanum (La) and/or cerium (Ce) is preferably contained in the steel. The form of such rare-earth elements (REM) to be added to ladle refining (molten steel) is not critical, and exemplary forms of REM to be added include pure elements such as pure La and pure Ce; alloys such as Fe—Si—La alloys, Fe—Si—Ce alloys, and Fe—Si—La—Ce alloys; and a misch metal. The misch metal is a mixture of cerium group rare-earth elements and, specifically, it contains from about 40% to about 50% of Ce and from about 20% to about 40% of La.

These effects according to the present invention are fully exhibited when applied to a high-strength steel sheet. As used herein the term "high-strength steel sheet" refers to a steel sheet having a tensile strength of 780 MPa or more, and especially preferably 980 MPa or more. The upper limit of the tensile strength herein is about 1200 MPa.

Though the present invention does not specify the manufacturing method of the steel sheet, it is recommended controlling the total rolling reduction of a rolling reduction at temperatures of about 1000° C. or lower in hot rolling and a rolling reduction in cold rolling (cold rolling reduction). The control is preferred for achieving the specific form of inclusions.

Though the compositions of inclusion particles are not specified herein as described above, inclusions in the steel sheet according to the present invention are often mainly composed of oxide inclusions in their chemical composition; and the oxide inclusions can be crushed and dispersed to form a specific group of inclusions during rolling performed at relatively low temperatures where the steel can plastically deform not so highly. The resulting finely divided and widely dispersed group of inclusions causes a huge and flat defect (void) upon bending, and a large stress concentrates in the vicinity of the defect to thereby cause bending fracture, as described above. It is therefore recommended to control the rolling reduction in the above-mentioned temperature range to relatively small to thereby suppress the degree of crushing of inclusions.

Specifically, possible oxide inclusions present in a steel sheet having a chemical composition specified in the present invention include single oxides of Al, Si, Mn, Mg, Ca, and rare-earth elements and/or composite oxides of these elements. In consideration of the deformation temperatures of these oxide inclusions and the deformation capability of the base steel, it is important to control the crush and dispersion of these oxide inclusions by adequately controlling the rolling reduction in a temperature range from about 1000° C. to room temperature. More specifically, it is important to control the crush and dispersion by optimizing the total rolling reduction of a rolling reduction at temperatures of about 1000° C. or lower in hot rolling and a rolling reduction in cold rolling.

More specifically, the total rolling reduction in the specific temperature range is preferably less than 98%, and more preferably 96% or less in a steel sheet having a chemical composition specified in the present invention. The total rolling reduction is the total of a rolling reduction at temperatures of about 1000° C. or lower in hot rolling and a rolling reduction in cold rolling. In contrast, if the total rolling reduction is excessively small, coarse inclusions may not be finely divided to thereby worsen the bending workability contrarily and may impede the manufacture of a thin steel sheet. The total rolling reduction is therefore preferably about 90% or more.

To reduce the total number of inclusion particles in the steel sheet, it is recommended to manufacture the steel by primarily refining a material in a converter or electric furnace, desulfurizing the refined material in a ladle according to a ladle furnace (LF) process, and thereafter subjecting the same to vacuum degassing according typically to a Ruhrstahl Heraeus (RH) process.

Conditions or procedures other than above are not critical, and a steel sheet can be manufactured according to a common procedure by making an ingot in the above manner, subjecting the ingot to continuous casting to give a billet such as slab, heating the billet to a temperature from about 1100° C. to about 1250° C., and subsequently sequentially performing hot rolling, coiling, acid-pickling, and cold rolling. The hot rolling is preferably finished at a finish temperature of equal to or higher than the $Ar_3$ point (the temperature at which austenite begins to transform to ferrite during cooling). The cold rolling reduction herein is preferably from about 20% to about 70%. Next, the obtained steel sheet is subjected to an annealing treatment. The annealing treatment is preferably performed by holding the steel sheet at a temperature of 750° C. to 900° C. for 10 to 200 seconds and thereafter cooling the steel sheet at a cooling rate of preferably 10° C. per second or more to thereby form a low-temperature transformation phase. The cooling procedure can be any suitable procedure such as water quenching, cooling with water-cooled rolls, mist cooling, or gas jet cooling. When the cooling is performed according to water quenching, an overaging process is preferably performed during cooling or after cooling to room temperature. In the overaging process, the steel sheet is reheated to a temperature of from 200° C. to 500° C. and held at the temperature for a duration of from about 30 seconds to about 5 minutes.

Next, the steel composition, steel structure, and manufacturing method of a steel sheet according to the second embodiment of the present invention will be illustrated below. In the following description, the "second embodiment of the present invention" will be simply referred to as "the present invention".

Steel Structure

A cold-rolled steel sheet according to the present invention, when used typically as a steel sheet for automobiles, needs both higher strength (880 MPa or more, preferably 980 MPa or more) and satisfactory workability. A steel sheet, if containing an excessively large amount of ferrite structure, may be difficult to ensure such high strength. A steel sheet, if containing a composite structure, may be difficult to develop sufficiently satisfactory bending workability. The bending workability is improved according to the present invention by allowing the steel sheet to have a martensite single-phase structure. The martensite structure is preferably one containing tempered martensite.

As used herein the term "martensite single-phase structure" means that the martensite structure occupies 95 percent by area or more, and especially preferably 97 percent by area or more, of the steel structure. The martensite structure can occupy 100 percent by area of the steel structure.

The steel sheet according to the present invention can contain, in addition to the martensite structure, any structure inevitably contained during manufacturing process, such as ferrite structure, bainite structure, and retained austenite structure.

The steel sheet should satisfy the following chemical composition so as to sufficiently exhibit effects of the control of structure, including the form of inclusions, so as to increase the bending workability reliably and to be a steel sheet having high strength and excellent workability in good balance. The steel sheet is recommended to be manufactured under manufacturing conditions mentioned later. Initially, the chemical composition of the steel sheet will be illustrated in detail below.

Chemical Composition of Steel Sheet

Carbon (C) content: 0.12% to 0.3%

Carbon (C) element is necessary for increasing the hardenability so as to ensure high strength of the steel sheet; and the carbon content should therefore be 0.12% or more, and is preferably 0.15% or more. However, the steel sheet, if containing carbon in excess, may be worsen in spot weldability and toughness or may often suffer from delayed fracture in a quenched area. The carbon content should therefore be 0.3% or less, and is preferably 0.26% or less.

Silicon (Si) content: 0.5% or less

Silicon (Si) element is effective for increasing resistance to temper softening and is also effective for improving the strength due to solid-solution strengthening. From these viewpoints, the Si content is preferably 0.02% or more. The silicon element, however, also helps the formation of ferrite, and, if contained in excess, may adversely affect the hardenability and impede insurance of high strength. The Si content should therefore be 0.5% or less and is preferably 0.4% or less.

Manganese (Mn) content: 1.5% to 3.0%

Manganese (Mn) element is effective for improving the hardenability so as to increase the strength of the steel sheet. The Mn content should be 1.5% or more and is preferably 1.7% or more to ensure sufficient hardenability. However, manganese, if contained in excess, may cause the steel sheet to have high strength more than necessary to thereby have inferior toughness. The Mn content should therefore be 3.0% or less and is preferably 2.8% or less.

Aluminum (Al) content: 0.15% or less

Aluminum (Al) element is added as a deoxidizer and has an activity of improving the corrosion resistance of the steel. The Al content is preferably 0.05% or more in order to exhibit these effects sufficiently. However, this element, if contained in excess, may form large amounts of carbon-based inclusions to cause surface flaw. To avoid this, the Al content should be 0.15%, is preferably 0.10% or less, and more preferably 0.07% or less.

Nitrogen (N) content: 0.01% or less

Nitrogen (N), if contained in excess, may precipitate as nitrides in larger amounts to thereby adversely affect the toughness. To avoid this, the nitrogen content should be 0.01% or less and is preferably 0.008% or less. The nitrogen content is generally 0.001% or more in consideration typically of the cost for steel making.

Phosphorus (P) content: 0.02% or less

Phosphorus (P) element acts to strengthen the steel but lowers the ductility thereof due to brittleness. The phosphorus content should therefore be controlled to 0.02% or less and is preferably 0.01% or less.

Sulfur (S) content: 0.01% or less

Sulfur (S) element forms sulfide inclusions to thereby worsen the workability and weldability of the steel sheet. To avoid this, the sulfur content is preferably minimized and should be controlled to be 0.01% or less in the present invention. The sulfur content is preferably 0.005% or less, and more preferably 0.003% or less.

The basic composition of the steel sheet specified in the present invention is as mentioned above, and the remainder includes iron and inevitable impurities. The steel sheet is accepted to contain, as the inevitable impurities, elements brought typically from raw materials, construction materials, and manufacturing facilities. The steel sheet may further positively contain the following elements within ranges not adversely affecting the operation of the present invention.

Chromium (Cr) in a content of 2.0% or less and/or boron (B) in a content of 0.01% or less Chromium (Cr) and boron (B) elements are both effective for improving the hardenability so as to increase the strength of the steel sheet. The Cr element is also effective for improving the resistance to temper softening of steel having a martensite structure. To exhibit these effects sufficiently, the Cr content is preferably 0.01% or more, and more preferably 0.05% or more; and the boron content is preferably 0.0001% or more, and more preferably 0.005% or more. Chromium, if contained in excess, may worsen the resistance to delayed fracture. Boron, if contained in excess, may adversely affect the ductility of the steel. To avoid these, the Cr content is preferably 2.0% or less and more preferably 1.7% or less, and the boron content is preferably 0.01% or less and more preferably 0.008% or less.

At least one element selected from the group consisting of copper (Cu) in a content of 0.5% or less, nickel (Ni) in a content of 0.5% or less, and titanium (Ti) in a content of 0.2% or less Copper (Cu), nickel (Ni), and titanium (Ti) elements are effective for improving the corrosion resistance of the steel to thereby improve the resistance to delayed fracture. These effects are effectively exhibited particularly in steel sheets having tensile strengths of more than 980 MPa. The Ti element is also effective for improving the resistance to temper softening. To exhibit these effects sufficiently, the Cu content is preferably 0.01% or more, and more preferably 0.05% or more; the Ni content is preferably 0.01% or more, and more preferably 0.05% or more; and the Ti content is preferably 0.01% or more, and more preferably 0.05% or more. However, these elements, if contained in excess, may worsen the ductility and/or workability. To avoid this, the Cu and Ni contents are each preferably 0.5% or less, and the Ti content is preferably 0.2% or less regarding the upper limits. The Cu and Ni contents are each more preferably 0.4% or less; and the Ti content is more preferably 0.15% or less.

Vanadium (V) in a content of 0.1% or less and/or niobium (Nb) in a content of 0.1% or less Vanadium (V) and niobium (Nb) elements are each effective for improving the strength and for finely dividing gamma grains to thereby improve the toughness after quenching. To exhibit these effects sufficiently, the vanadium content and niobium content are each preferably 0.003% or more, and more preferably 0.02% or more. However, these elements, if contained in excess, may cause increased amounts of precipitates such as carbonitrides to thereby worsen the workability and resistance to delayed fracture. To avoid this, the vanadium content and niobium content are each preferably 0.1% or less and more preferably 0.05% or less.

To further improve the corrosion resistance and/or the resistance to delayed fracture, a total of 0.01% or less of one or more additional elements may be added to the steel, which additional elements include Se, As, Sb, Pb, Sn, Bi, Mg, Zn, Zr, W, Cs, Rb, Co, La, Tl, Nd, Y, In, Be, Hf, Tc, Ta, O, and Ca.

The effects of the present invention are fully exhibited when applied to high-strength steel sheets having tensile strengths of 880 MPa or more, and especially preferably 980 MPa or more.

Though the present invention does not specify the manufacturing method of the steel sheet, it is recommended to control the total rolling reduction of a rolling reduction at temperatures of about 950° C. or lower in hot rolling and a rolling reduction in cold rolling (cold rolling reduction). The control is preferred for achieving the specific form of inclusions.

Though the compositions of inclusion particles are not specified herein as described above, inclusions in the steel sheet according to the present invention are often mainly composed of oxide inclusions in their chemical compositions; and the oxide inclusions can be crushed and dispersed to form a specific group of inclusions during rolling performed at relatively low temperatures where the steel can plastically deform not so highly. The resulting finely divided and widely dispersed group of inclusions causes a huge and flat defect (void) upon bending, and large stress concentrates in the vicinity of the defect to thereby cause bending fracture, as described above. It is therefore recommended to control the rolling reduction in the above-mentioned temperature range to relatively small to thereby suppress the degree of crushing.

Specifically, possible oxide inclusions present in a steel sheet having a chemical composition specified in the present invention include single oxides of Al, Si, Mn, Ti, Mg, Ca, and rare-earth elements and/or composite oxides of these elements. In consideration of the deformation temperatures of these oxide inclusions and the deformation capability of the base steel, it is important to control the crush and dispersion of these oxide inclusions by adequately controlling the rolling reduction in a temperature range from about 950° C. to room temperature. More specifically, it is important to control the crush and dispersion by optimizing the total rolling reduction of a rolling reduction at temperatures of about 950° C. or lower in hot rolling and a rolling reduction in cold rolling.

More specifically, the total rolling reduction in the specific temperature range is preferably less than 97%, and more preferably 95% or less in a steel sheet having a chemical composition specified in the present invention. The total rolling reduction is the total of a rolling reduction at temperatures of about 950° C. or lower in hot rolling and a rolling reduction in cold rolling. In contrast, if the total rolling reduction is excessively small, coarse inclusions may not be finely divided to thereby worsen the bending workability contrarily and may impede the manufacture of a thin steel sheet. The total rolling reduction is therefore preferably about 90% or more.

To reduce the total number of inclusion particles in the steel sheet, it is recommended to manufacture the steel by deoxidizing a material with aluminum to give a killed steel, primarily refining the killed steel in a converter or electric furnace, desulfurizing the refined material in a ladle according to a ladle furnace (LF) process, and thereafter subjecting the same to vacuum degassing according typically to Ruhrstahl Heraeus (RH) process.

Conditions or procedures other than above are not critical, and the steel sheet can be manufactured according to a common procedure by making an ingot in the above manner, subjecting the ingot to continuous casting to give a billet such as slab, heating the billet to a temperature from about 1100° C. to about 1250° C., and subsequently sequentially performing hot rolling, coiling, acid-pickling, and cold rolling. The hot rolling is preferably finished at a finish temperature of equal to or higher than the $Ar_3$ point. The cold rolling reduction herein is preferably from about 30% to about 70%. Next, the prepared steel sheet is subjected to an annealing treatment. In the annealing treatment, tempering is preferably performed to give a martensite single-phase structure, in which the steel is held at a temperature typically of 800° C. to 1000° C. for 5 to 300 seconds, cooled from a temperature of from 600° C. to 1000° C. (quenching start temperature) to room temperature through quenching at a rate typically of 20° C. per second or more, the quenched steel is reheated to a temperature range of from 100° C. to 600° C., and held at the temperature range for 0 to 1200 seconds.

The annealing treatment in the first and second embodiments of the present invention may be performed typically in a hot-dip galvanization line when a hot-dip galvanized steel sheet or hot-dip galvannealed steel sheet mentioned below is to be manufactured.

The first and second embodiments of the present invention further include, in addition to cold-rolled steel sheets, hot-dip galvanized steel sheets (GI steel sheets) prepared by subjecting the cold-rolled steel sheets to hot-dip galvanization; and hot-dip galvannealed steel sheets (GA steel sheets) prepared by subjecting the cold-rolled steel sheets to hot-dip galvanization and thereafter subjecting the galvanized steel sheets to alloying treatments, respectively. These plating treatments improve the corrosion resistance of the steel sheets. The plating treatments and alloying treatments can be performed under conditions generally employed.

The high-strength cold-rolled steel sheets according to the first and second embodiments of the present invention are usable for the manufacture of automotive strengthening parts including bumping parts such as front and rear side members and crush boxes; pillars such as center pillar reinforcing members; body-constituting parts such as roof rail reinforcing members, side sills, floor members, and kick-up portions (or kick plates); and seat parts.

EXAMPLES

The present invention (the first and second embodiments of the present invention) will be illustrated in further detail with reference to several working examples below. It should be noted, however, that these examples are never intended to limit the scope of the present invention; various alternations and modifications may be made without departing from the scope and spirit of the present invention and are all included within the technical scope of the present invention.

Experimental Example 1

Working examples relating to the first embodiment of the present invention will be shown below.

Material steels having chemical compositions given in Table 1 were melted to give ingots. Specifically, the material steels were subjected to primary refining in a converter and thereafter to desulfurization in a ladle. Where necessary, the steels after ladle refining were subjected to a vacuum degassing treatment according typically to the RH process. The steels were then subjected to continuous casting according to a common procedure to give slabs. The slabs were subjected sequentially to hot rolling, acid pickling according to a common procedure, and cold rolling and thereby yielded steel sheets 1.6 mm thick (gage). Next, the steel sheets were subjected to continuous annealing. In the continuous annealing, the steel sheets were held at 780° C. to 830° C. for 180 seconds, thereafter quenched to room temperature, reheated to 350° C., and held at the same temperature (350° C.) for 100 seconds so as to perform an overaging process to thereby allow the steel structure to be a ferrite-martensite composite structure. The total rolling reductions of the rolling reduction at temperatures of about 1000° C. or lower in the hot rolling and the rolling reduction in the cold rolling are shown in Table 2. The hot rolling conditions are as follows.

Hot Rolling

Heating Temperature: 1250° C.

Finish Temperature: 880° C.

Coiling Temperature: 550° C.

Finish Gage: 2.6 to 3.2 mm

Next, test pieces were prepared from the above-prepared steel sheets (steel hoops) and subjected to observation of the structure and to evaluation of characteristic properties mentioned below.

Measurement of Group of Inclusions

Each three test pieces per one position were sampled from the steel hoops at positions of one-eighth, one-fourth, one-second, three-fourths, and seven-eighths the width in the width direction of the steel hoops. The sampling positions were arbitrary positions with respect to the rolling direction. The test pieces each had a size of 30 mm square in a rolling plane. The test pieces were ground in the rolling plane (normal direction (ND)) from the surface to 0.1t (t: gage) at intervals of 10 μu, the ground surfaces were visually observed under an optical microscope of 100 magnifications at every grinding (at every 10-μm grinding) to identify positions of inclusions. The number of specific groups of inclusions was counted. The counted number was converted to a number per the observed area and then converted to a number density per 100 $cm^2$ of a rolling plane. The determined number densities of specific groups of inclusions are shown in Table 2. The specific groups of inclusions herein were the n-ary groups of inclusions in which the distance in the steel sheet rolling direction between outermost surfaces of two outermost particles of the n-ary group of inclusions was 80 μm or more.

Observation of Microstructure

Test pieces 1.6 mm thick, 20 mm wide, and 20 mm long were cut from the steel sheets, cross sections of the test pieces in parallel with the rolling direction were polished, subjected to LePera etching, and positions at a depth of one-fourth the thickness (gage) were subjected to the measurements. Specifically, an observation area of about 80 μm long and 60 μm wide was observed under an optical microscope of 1000 magnifications. The measurements were performed in arbitrary five visual fields. The determined structures are shown in Table 2.

Evaluation of Tensile Properties

The tensile strengths (TS) were measured in the following manner. Number 5 test pieces for tensile tests specified in Japanese Industrial Standards (JIS) Z 2201 were sampled from the steel sheets so that a direction perpendicular to the steel sheet rolling direction was in parallel with the longitudinal direction of the test pieces; and the tensile strengths of the test pieces were measured in accordance with JIS Z 2241. In Experimental Example 1, samples having tensile strengths of 780 MPa or more were evaluated as having high strength. The results are shown in Table 2. For the sake of reference, the yield strengths (YS) of the steel sheets are also shown in Table 2.

Evaluation of Bending Workability: Measurement of rate of bending fracture caused by specific groups of inclusions Folding bending was performed on 1000 test pieces per sample under the following conditions. Regarding test pieces undergone fracture, a cross section (thickness direction) of the fracture starting point was observed through scanning electron microscopy (SEM) and energy dispersive X-ray spectroscopy (EDX) to determine the presence or absence of any specific group of inclusions. It was found that all specific groups of inclusions acting as fracture starting points and causing fracture were present in a region from the surface to a depth of 0.1t.

The rate (%) of bending fracture caused by specific groups of inclusions was determined according to the formula: 100× (Number of test pieces undergone bending fracture and containing at least one specific group of inclusions)/(Total number of test pieces, i.e., 1000). The results are shown in Table 2.

Conditions for Folding Bending

Processing Machine: NC1-80(2)-B supplied by Aida Engineering, Ltd.

Processing Speed: 40 strokes per minute (SPM)

Clearance: gage plus 0.1 mm

Die Punch Radius: critical bending factor (R/t) of the material plus 0.5/t wherein R represents the die radius (mm); and t represents the thickness (gage) (mm) of the test piece Punch Angle: 90°

Test Piece Size: t in thickness, 80 mm or more in width, and 30 mm in length, wherein the direction of L (longitudinal direction) was in parallel with the rolling direction of the steel hoop Bending Direction: The bending edge line was in parallel with the rolling direction of the test piece Tested Number and Tested Position: Each 200 test pieces per one position were measured at positions of one-eighth, one-fourth, one-second, three-fourths, and seven-eighths the width in the width direction of the steel hoop, namely, a total of 1000 test pieces were measured per one steel hoop, in which the positions were arbitrary positions with respect to the longitudinal direction of the steel hoop.

Determination of Critical Bending Factor

Bending was performed according to the following procedure at different bending radii of, for example, 2.0 mm, 1.5 mm, and 1.0 mm, and a minimum bending radius where no bending fracture occurred was defined as the critical bending factor.

Folding Bending

Measurement Positions and Tested Number: at one-fourth the width position, each two test pieces per one bending radius The other conditions were the same as above.

TABLE 1

| Steel type | Chemical composition (percent by mass) * | | | | | | | | | |
|---|---|---|---|---|---|---|---|---|---|---|
| | C | Si | Mn | P | S | Al | Ca | Mg | Rare-earth element | Additional element |
| A | 0.17 | 1.35 | 2.0 | 0.008 | 0.002 | 0.04 | — | — | — | — |
| B | 0.02 | 0.50 | 2.0 | 0.013 | 0.002 | 0.04 | — | — | — | — |
| C | 0.15 | 1.30 | 2.2 | 0.005 | 0.060 | 0.03 | — | — | — | — |
| D | 0.16 | 1.32 | 1.9 | 0.008 | 0.002 | 0.20 | — | — | — | — |
| E | 0.18 | 1.32 | 1.8 | 0.007 | 0.002 | 0.04 | 0.002 | — | — | — |
| F | 0.18 | 1.32 | 1.8 | 0.014 | 0.002 | 0.04 | 0.012 | — | — | — |
| G | 0.18 | 1.34 | 1.9 | 0.009 | 0.002 | 0.03 | — | 0.003 | — | — |
| H | 0.17 | 1.35 | 2.1 | 0.013 | 0.002 | 0.04 | — | — | La: 0.003 | — |
| I | 0.07 | 1.30 | 1.9 | 0.014 | 0.002 | 0.03 | — | — | — | — |
| J | 0.08 | 1.50 | 2.2 | 0.012 | 0.002 | 0.04 | — | — | — | Cr: 0.7 |
| K | 0.09 | 1.22 | 2.1 | 0.013 | 0.002 | 0.03 | — | — | — | Mo: 0.3 |
| L | 0.12 | 1.20 | 2.2 | 0.006 | 0.002 | 0.04 | — | — | — | Ti: 0.02 |
| M | 0.12 | 1.15 | 2.2 | 0.009 | 0.002 | 0.03 | — | — | — | Nb: 0.02 |
| N | 0.13 | 1.21 | 2.1 | 0.006 | 0.002 | 0.04 | — | — | — | V: 0.02 |
| O | 0.16 | 1.17 | 2.3 | 0.009 | 0.003 | 0.04 | — | — | — | Cu: 0.4, Ni: 0.4 |
| P | 0.20 | 1.13 | 2.0 | 0.008 | 0.003 | 0.03 | — | — | — | — |

* The remainder including iron and inevitable impurities

TABLE 2

| Sample No. | Steel type | Rolling reduction*1 (%) | Number density of specific groups of inclusions*2 (number/100 $cm^2$) | Steel sheet structure (F: ferrite, M: martensite) | TS (MPa) | YS (MPa) | Rate of bending fracture caused by specific groups of inclusions (%) |
|---|---|---|---|---|---|---|---|
| 1 | A | 95 | 68 | F + M | 1000 | 772 | 0.5 |
| 2 | A | 98 | 143 | F + M | 989 | 774 | 3.6 |
| 3 | A | 90 | 62 | F + M | 1039 | 789 | 0.7 |
| 4 | B | 97 | 42 | F + M | 483 | 400 | 0.2 |
| 5 | C | 96 | 158 | F + M | 1004 | 767 | 3.5 |
| 6 | D | 94 | 178 | F + M | 1011 | 789 | 3.2 |
| 7 | E | 95 | 116 | F + M | 994 | 788 | 1.4 |
| 8 | E | 98 | 194 | F + M | 998 | 790 | 4.9 |
| 9 | F | 94 | 242 | F + M | 1022 | 777 | 6.3 |
| 10 | G | 97 | 98 | F + M | 1001 | 766 | 0.8 |
| 11 | G | 98 | 150 | F + M | 1003 | 763 | 2.4 |
| 12 | H | 96 | 78 | F + M | 1012 | 766 | 0.6 |
| 13 | P | 95 | 86 | F + M | 1193 | 997 | 1.1 |
| 14 | I | 96 | 60 | F + M | 910 | 716 | 0.4 |
| 15 | J | 96 | 84 | F + M | 1089 | 866 | 1.5 |
| 16 | K | 97 | 49 | F + M | 1054 | 850 | 1.1 |
| 17 | L | 97 | 51 | F + M | 1189 | 998 | 0.9 |
| 18 | M | 96 | 63 | F + M | 1102 | 960 | 0.7 |
| 19 | N | 97 | 78 | F + M | 1191 | 991 | 0.9 |
| 20 | O | 96 | 59 | F + M | 1184 | 910 | 1.2 |

*1Total rolling reduction of the rolling reduction at temperatures of about 1000° C. or lower in hot rolling and the rolling reduction in cold rolling

*2Number density of groups of inclusions having major axes of 80 μm or more

Tables 1 and 2 demonstrate as follows. Samples Nos. 1, 3, 7, 10, and 12 to 20 satisfy the conditions specified according to the first embodiment of the present invention, show small rates of bending fracture caused by specific groups of inclusions, and excel in bending workability. In contrast, Samples Nos. 2, 8, and 11 have high number densities of groups of inclusions and are inferior in bending workability. This is probably because draft from about 1000° C. to room temperature in the manufacturing process of these steel sheets was performed each at a rolling reduction out of the recommended range. Sample No. 4 has an insufficient carbon content and thereby fails to give a high-strength steel sheet. Sample No. 5 has an excessively high sulfur content and thereby has a large number density of specific groups of inclusions, resulting in inferior bending workability. Sample No. 6 and Sample No. 9 have an excessively high Al content and an excessively high Ca content, respectively, and thereby both suffer from large number densities of specific groups of inclusions, resulting in inferior bending workability.

Experimental Example 2

Working examples relating to the second embodiment of the present invention will be shown below.

Material steels having chemical compositions given in Table 3 were melted to give ingots. Specifically, the material steels were subjected to primary refining and thereafter subjected to desulfurizing in a ladle. Where necessary, the steels after ladle refining were subjected to a vacuum degassing treatment according typically to the RH process. The steels were then subjected to continuous casting according to a common procedure to give slabs. The slabs were subjected sequentially to hot rolling, acid pickling according to a common procedure, and cold rolling and thereby yielded steel sheets 1.6 mm thick (gage). Next, the steel sheets were subjected to continuous annealing. In the continuous annealing, the steel sheets were held at annealing temperatures given in Table 4 for 180 seconds, thereafter cooled to quenching start temperatures given in Table 4 each at a cooling rate of 10° C. per second, quenched from the quenching start temperature to room temperature at a cooling rate of 20° C. per second or more, reheated to tempering temperatures given in Table 4, and held at the tempering temperatures for 100 seconds to have a martensite single-phase structure. The total rolling reductions of the rolling reduction at temperatures of about 950° C. or lower in the hot rolling and the rolling reduction in the cold rolling are shown in Table 4. The hot rolling was performed under the same conditions as in Experimental Example 1.

Next, test pieces were prepared from the above-prepared steel sheets (steel hoops) and subjected to the observation of the structure and to the evaluations of characteristic properties mentioned below.

Measurement of Groups of Inclusions

The measurement of groups of inclusions was performed by the procedure of Experimental Example 1. The results (number densities of specific groups of inclusions) are shown in Table 4.

Observation of Microstructure

The observation of microstructure was performed by the procedure of Experimental Example 1. As a result, all the samples had a martensite single-phase structure including 95 percent by area or more of a martensite structure.

Evaluation of Tensile Properties

The tensile strengths (TS) were measured by the procedure of Experimental Example 1. In Experimental Example 2, samples having tensile strengths of 880 MPa or more were evaluated as having high strength. The results are shown in Table 4. For the sake of reference, the yield strengths (YP) and elongations (EL) of the steel sheets are also shown in Table 4.

Evaluation of Bending Workability: Measurement of rate of bending fracture caused by specific groups of inclusions The bending workability was evaluated by the procedure of Experimental Example 1. The results are shown in Table 4.

TABLE 3

| Steel type | Chemical composition (percent by mass)* | | | | | | | | | | | | | |
|---|---|---|---|---|---|---|---|---|---|---|---|---|---|---|
| | C | Si | Mn | P | S | Al | N | Cr | B | Cu | Ni | Ti | Nb | V |
| A | 0.15 | 0.01 | 2.0 | 0.004 | 0.002 | 0.07 | 0.008 | 0.08 | — | — | — | — | — | — |
| B | 0.14 | 0.01 | 2.0 | 0.004 | 0.003 | 0.07 | 0.007 | 0.08 | — | — | — | — | — | — |
| C | 0.20 | 0.02 | 2.0 | 0.002 | 0.004 | 0.07 | 0.004 | 0.08 | — | — | — | 0.05 | — | — |
| D | 0.23 | — | 2.0 | 0.005 | 0.003 | 0.07 | 0.003 | 0.08 | — | — | — | 0.05 | — | — |
| E | 0.15 | 0.02 | 2.0 | 0.010 | 0.002 | 0.07 | 0.008 | 0.08 | — | 0.10 | 0.10 | — | — | — |
| F | 0.15 | 0.01 | 2.0 | 0.008 | 0.002 | 0.07 | 0.005 | 0.08 | — | 0.10 | 0.10 | 0.05 | — | — |
| G | 0.20 | — | 2.0 | 0.009 | 0.003 | 0.07 | 0.008 | 0.08 | — | 0.10 | 0.10 | 0.05 | — | — |
| H | 0.23 | 0.02 | 2.0 | 0.008 | 0.003 | 0.07 | 0.007 | 0.08 | — | 0.10 | 0.10 | 0.05 | — | — |
| I | 0.12 | 0.40 | 3.0 | 0.010 | 0.001 | 0.05 | 0.008 | — | — | — | — | — | — | — |
| J | 0.28 | 0.01 | 1.5 | 0.011 | 0.003 | 0.04 | 0.007 | 0.05 | 0.0007 | — | — | — | — | — |
| K | 0.20 | — | 2.0 | 0.002 | 0.002 | 0.03 | 0.005 | — | 0.0050 | — | — | — | — | — |
| L | 0.29 | 0.02 | 1.8 | 0.015 | 0.002 | 0.05 | 0.007 | — | — | 0.40 | 0.40 | — | — | — |
| M | 0.17 | — | 1.5 | 0.018 | 0.002 | 0.07 | 0.006 | 1.00 | — | — | — | 0.15 | — | — |
| N | 0.15 | 0.01 | 2.8 | 0.012 | 0.001 | 0.08 | 0.007 | 1.50 | — | — | — | — | — | 0.060 |
| 0 | 0.20 | 0.01 | 2.4 | 0.009 | 0.002 | 0.10 | 0.005 | — | — | — | — | — | 0.050 | — |
| P | 0.23 | 0.02 | 2.0 | 0.008 | 0.001 | 0.15 | 0.006 | 0.07 | — | 0.20 | 0.20 | — | 0.040 | — |
| Q | 0.20 | — | 1.5 | 0.004 | 0.001 | 0.04 | 0.006 | — | 0.0090 | — | — | — | — | 0.050 |
| R | 0.30 | 0.45 | 1.5 | 0.011 | 0.002 | 0.10 | 0.004 | — | — | — | — | — | — | — |
| S | 0.12 | — | 2.5 | 0.004 | 0.001 | 0.04 | 0.003 | — | — | — | — | — | — | — |
| T | 0.23 | 0.20 | 2.0 | 0.009 | 0.002 | 0.07 | 0.007 | — | — | — | — | — | — | — |

*The remainder including iron and inevitable impurities

TABLE 4

| Sample No. | Steel type | Rolling reduction*1 (%) | Annealing temperature (° C.) | Quenching start temperature (° C.) | Tempering temperature (° C.) | YP (MPa) | TS (MPa) | EL (%) | Number density of specific groups of inclusions*2 (number/100 cm$^2$) | Rate of bending fracture caused by specific groups of inclusions (%) |
|---|---|---|---|---|---|---|---|---|---|---|
| 1 | A | 94 | 900 | 675 | 450 | 783 | 900 | 7.5 | 60 | 0.7 |
| 2 | | 98 | 900 | 700 | 450 | 785 | 920 | 7.0 | 126 | 2.6 |
| 3 | B | 95 | 900 | 675 | 500 | 790 | 915 | 8.7 | 100 | 1.0 |
| 4 | | 97 | 900 | 670 | 400 | 788 | 905 | 8.0 | 153 | 3.5 |
| 5 | C | 95 | 900 | 670 | 400 | 957 | 1130 | 6.2 | 112 | 1.5 |
| 6 | D | 94 | 920 | 665 | 450 | 950 | 1120 | 6.2 | 85 | 0.6 |
| 7 | E | 93 | 900 | 675 | 200 | 1167 | 1380 | 6.3 | 35 | 0.7 |
| 8 | F | 92 | 930 | 680 | 200 | 1136 | 1320 | 6.1 | 25 | 0.4 |
| 9 | G | 95 | 900 | 690 | 250 | 1360 | 1550 | 5.2 | 65 | 0.9 |
| 10 | | 97 | 940 | 700 | 180 | 1305 | 1500 | 5.6 | 129 | 2.8 |
| 11 | H | 94 | 900 | 730 | 180 | 1370 | 1620 | 6.8 | 93 | 0.8 |
| 12 | | 98 | 940 | 800 | 200 | 1350 | 1580 | 5.5 | 168 | 3.9 |
| 13 | I | 93 | 900 | 890 | 180 | 1120 | 1320 | 6.7 | 54 | 0.9 |
| 14 | | 98 | 930 | 900 | 200 | 1100 | 1310 | 6.4 | 150 | 4.0 |
| 15 | J | 90 | 900 | 700 | 200 | 1490 | 1760 | 5.8 | 86 | 1.2 |
| 16 | | 98 | 850 | 820 | 200 | 1560 | 1830 | 5.9 | 162 | 4.3 |
| 17 | K | 98 | 900 | 900 | 250 | 1280 | 1480 | 5.5 | 143 | 3.6 |
| 18 | L | 90 | 900 | 675 | 450 | 1230 | 1370 | 6.2 | 20 | 0.5 |
| 19 | M | 95 | 920 | 650 | 500 | 1100 | 1180 | 6.7 | 22 | 0.8 |
| 20 | N | 94 | 900 | 650 | 200 | 780 | 930 | 7.5 | 55 | 0.2 |
| 21 | O | 96 | 890 | 690 | 180 | 1120 | 1310 | 6.2 | 45 | 0.3 |
| 22 | P | 96 | 900 | 690 | 500 | 980 | 1090 | 6.8 | 16 | 0.4 |
| 23 | Q | 95 | 890 | 700 | 200 | 1280 | 1470 | 5.8 | 40 | 0.5 |
| 24 | R | 95 | 900 | 700 | 300 | 1370 | 1580 | 7.0 | 88 | 1.0 |
| 25 | | 97 | 850 | 650 | 200 | 1320 | 1510 | 6.8 | 127 | 3.0 |
| 26 | S | 94 | 900 | 650 | 500 | 850 | 980 | 9.2 | 17 | 0.8 |
| 27 | T | 93 | 900 | 700 | 550 | 1075 | 1250 | 8.3 | 78 | 0.9 |

*1Total rolling reduction of the rolling reduction at temperatures of about 950° C. or lower in hot rolling and the rolling reduction in cold rolling
*2Number density of groups of inclusions having major axes of 100 μm or more Tables 3 and 4 demonstrate as follows. Samples Nos. 1, 3, 5 to 9, 11, 13, 15, 18 to 24, 26, and 27 satisfy the conditions specified according to the second embodiment of the present invention, show small rates of bending fracture caused by inclusions, and excel in bending workability. In contrast, Samples Nos. 2, 4, 10, 12, 14, 16, 17, and 25 have high number densities of groups of inclusions and are inferior in bending workability. This is probably because draft from about 950° C. to room temperature in the manufacturing process of these steel sheets was performed each at a rolling reduction out of the recommended range.

What is claimed is:

1. A cold-rolled steel sheet comprising a steel having a composition of:

a carbon (C) content of from 0.05 percent by mass to 0.3 percent by mass (hereinafter "%" means % by mass);

a silicon (Si) content of 3.0% or less:

a manganese (Mn) content of from 1.5% to 3.5%;

a phosphorus (P) content of 0.1% or less;

a sulfur (A) content of 0.05% or less; and an aluminum (Al) content of 0.15% or less, with the remainder including iron and inevitable impurities, wherein the steel has a microstructure comprising a composite structure including a ferrite structure and a martensite-containing second phase, and wherein, in a surface region from a surface to a depth one-tenth the gage of the steel sheet, the number density of n-ary groups of inclusions is 120 or less per 100 $cm^2$ of a rolling plane, in which each of the n-ary groups of inclusions is determined by an n-th Determination mentioned below, and, in each of the n-ary groups of inclusions, the distance in a steel sheet rolling direction between outermost surfaces of two outermost particles of the n-ary group of inclusions is 80 μm or more:

n-th Determination the "n-ary group of inclusions" is a group of inclusions which includes (1) an inclusion selected from an (n−1)-ary group of inclusions (wherein "n" is an integer of 1 or more and (2) at least one inclusion selected from neighboring x-ary group of inclusions and inclusion particles where "x" is an integer from 0 to n−1, in which the minimum intersurface distance (λ) of nearest neighbor particles between the (n−1)-ary group of inclusions and the x-ary group of inclusions satisfies a condition represented by following Expression (1-1) and is 60 μm or less:

$$\lambda \leqq (1.9-0.0015\sigma_y)\times(d_1+d_2) \quad (1\text{-}1)$$

wherein

λ represents the minimum intersurface distance (μm) of nearest neighbor particles between the (n−1)-ary group of inclusions and the x-ary group of inclusions;

$\sigma_y$ represents the yield strength (MPa) of the steel sheet;

$d_1$ represents the particle size (μm), in a steel sheet rolling direction, of the (n−1)-ary group of inclusions when "n" is 1, or represents the distance (μm), in a steel sheet rolling direction, between outermost surfaces of two outermost particles of the (n−1)-ary group of inclusions when "n" is 2 or more; and $d_2$ represents the particle size (μm), in a steel sheet rolling direction, of the x-ary group of inclusions when "x" is 0, or represents the distance (μm), in a steel sheet rolling direction, between outermost surfaces of two outermost particles of the x-ary group of inclusions when "x" is 1 or more.

2. The cold-roiled steel sheet according to claim 1, wherein the steel further comprises, as additional element(s), at least one element selected from the group consisting of chromium (Cr) in a content of 1% by mass or less and molybdenum (Mo) in a content of 0.5% by mass or less.

3. The cold-rolled steel sheet according to claim 1, wherein the steel further comprises, as additional element(s), at least one element selected from the group consisting of:

titanium (Ti) in a content of 0.2% by mass or less;

vanadium (V) in a content of 0.2% by mass or less; and niobium (Nb) in a content of 0.3% by mass or less.

4. The cold-rolled steel sheet according to claim 1, wherein the steel further comprises, as additional element(s), at least one element selected from the group consisting of copper (Cu) in a content of 0.5% by mass or less and nickel (Ni) in a content of 0.5% by mass or less.

5. The cold-rolled steel sheet according to claim 1, wherein the steel further comprises, as additional element(s), at least one element selected from the group consisting of:

calcium (Ca) in a content of 0.010% by mass or less; magnesium (Mg) in a content of 0.010% by mass or less; and one or more rare-earth elements in a content of 0.005% by mass or less.

6. A hot-dip galvanized steel sheet comprising the cold-rolled steel sheet according to claim 1; and a hot-dip galvanized coating formed on the cold-rolled steel sheet through hot-dip galvanization.

7. A hot-dip galvannealed steel sheet comprising the cold-rolled steel sheet according to claim 1; and a hot-dip galvannealed coating formed on the cold-rolled steel sheet through hot-dip galvanization and alloying.

8. The cold-rolled sheet according to claim 1, where the number density of n-ary groups of inclusions is 42 to 120 or less per 100 $cm^2$ of a rolling plane.

9. A cold-rolled steel sheet comprising a steel having a composition of:

a carbon (C) content of from 0.12 percent by mass to 0.3 percent by mass (hereinafter "%" means % by mass)

a silicon (Si) content of 0.5% or less;

a manganese (Mn) content of from 1.5% to 3.0%;

an aluminum (Al) content of 0.15% or less;

a nitrogen (N) content of 0.01% or less;

a phosphorus (P) content of 0.02% or less; and a sulfur (S) content of 0.01% or less, with the remainder including iron and inevitable impurities, wherein the steel has a microstructure comprising a martensite single-phase structure, and wherein, in a surface region from a surface to a depth one-tenth the gage of the steel sheet, the number density of n-ary groups of inclusions is 120 or less per 100 $cm^2$ of a rolling plane, in which each of the n-ary groups of inclusions is determined by an n-th Determination mentioned below, and, in each of the n-ary groups of inclusions, the distance in a steel sheet rolling direction between outermost surfaces of two outermost particles of the n-ary group of inclusions is 100 μm or more:

n-th Determination the "n-ary group of inclusions" refers to a group of inclusions which includes (1) an inclusion selected from an (n−1)-ary group of inclusions where "n" is an integer of 1 or more and (2) at least one inclusion selected from neighboring x-ary group of inclusions and inclusion particles where "x" is an integer from 0 to n−1, in which the minimum intersurface distance (λ) of nearest neighbor particles between the (n−1)-ary group of inclusions and the x-ary group of inclusions satisfies a condition represented by following Expression (1-2) and is 60 μm or less:

$$\lambda \leq 4.0\times10^5\left(\frac{1}{\sigma_y}\right)^2(d_1+d_2) \quad (1\text{-}2)$$

wherein

λ represents the minimum intersurface distance (μm) of nearest neighbor particles between the (n−1)-ary group of inclusions and the x-ary group of inclusions;

$\sigma_y$ represents the yield strength (MPa) of the steel sheet;

$d_1$ represents the particle size (μm), in a steel sheet rolling direction, of the (n−1)-ary group of inclusions when "n" is 1, or represents the distance (μm), in a steel sheet rolling direction, between outermost surfaces of two outermost particles of the (n−1)-ary group of inclusions when "n" is 2 or more; and $d_2$ represents the particle size (μm), in a steel sheet rolling direction, of the x-ary group of inclusions when "x" is 0, or represents the distance (μm), in a steel sheet rolling direction, between outermost surfaces of two outermost particles of the x-ary group of inclusions when "x" is 1 or more.

10. The cold-rolled steel sheet according to claim 9, wherein the steel further comprises, as additional element(s), at least one element selected from the group consisting of chromium (Cr) in a content of 2.0% by mass or less and boron (B) in a content of 0.01% by mass or less.

11. The cold-rolled steel sheet according to claim 9, wherein the steel further comprises, as additional element(s), at least one element selected from the group consisting of:

copper (Cu) in a content of 0.5% by mass or less;

nickel (Ni) in a content of 0.5% by mass or less; and titanium (Ti) in a content of 0.2% by mass or less.

12. The cold-rolled steel sheet according to claim 9, wherein the steel further comprises, as additional element(s), at least one element selected from the group consisting of vanadium (V) in a content of 0.1% by mass or less and niobium (Nb) in a content of 0.1% by mass or less.

13. A hot-dip galvanized steel sheet comprising the cold-rolled steel sheet according to claim 9; and a hot-dip galvanized coating formed on the cold-rolled steel sheet through hot-dip galvanization.

14. A hot-dip galvannealed steel sheet comprising the cold-rolled steel sheet according to claim 9; and a hot-dip galvannealed coating formed on the cold-rolled steel sheet through hot-dip galvanization and alloying.

15. The cold-rolled sheet according to claim 9, where the number density of n-ary groups of inclusions is 16 to 120 or less per 100 $cm^2$ of a rolling plane.

* * * * *